US010637123B2

(12) United States Patent
Yasuda

(10) Patent No.: US 10,637,123 B2
(45) Date of Patent: Apr. 28, 2020

(54) DIRECTIONAL COUPLER

(71) Applicant: TAIYO YUDEN CO., LTD., Tokyo (JP)

(72) Inventor: Hisahiro Yasuda, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 16/047,774

(22) Filed: Jul. 27, 2018

(65) Prior Publication Data

US 2019/0067784 A1 Feb. 28, 2019

(30) Foreign Application Priority Data

Aug. 31, 2017 (JP) ..... 2017-167771

(51) Int. Cl.
*H01P 5/18* (2006.01)

(52) U.S. Cl.
CPC ..... *H01P 5/185* (2013.01); *H01P 5/187* (2013.01)

(58) Field of Classification Search
CPC ..... H01P 5/18; H01P 5/184
USPC ..... 333/109, 112, 116
See application file for complete search history.

(56) References Cited

U.S. PATENT DOCUMENTS 3,737,810 A * 6/1973 Shelton ..... H01P 1/184 333/116
5,689,217 A 11/1997 Gu et al. ..... 333/116
6,208,220 B1 * 3/2001 Logothetis ..... H01P 5/185 333/116
6,515,556 B1 * 2/2003 Kato ..... H01P 5/10 333/116
8,063,715 B2 * 11/2011 Sasaki ..... H01P 5/187 333/116
2005/0146394 A1 7/2005 Podell ..... 333/116
2013/0241667 A1 * 9/2013 Tamaru ..... H01P 5/187 333/109
2014/0085019 A1 * 3/2014 Mei ..... H01P 5/187 333/117
2015/0002239 A1 1/2015 Tanaka ..... 333/116
2015/0109069 A1 4/2015 Katabuchi et al. ..... H01P 5/184
2016/0268668 A1 * 9/2016 Mitake ..... H01P 5/184

FOREIGN PATENT DOCUMENTS

JP 2015-12323 A 1/2015
JP 2015-109630 A 6/2015

* cited by examiner

*Primary Examiner* — Dean O Takaoka
(74) *Attorney, Agent, or Firm* — Stein IP, LLC

(57) ABSTRACT

A directional coupler includes: a main line electrically connected between input and output terminals and including a first line, a second line connecting the first line and the input terminal, and a third line connecting the first line and the output terminal; a sub line electrically connected between coupling and isolation terminals and including a fourth line electromagnetically coupled with the first line, a fifth line electromagnetically coupled with the second line, and a sixth line electromagnetically coupled with the third line, the fifth line connecting the fourth line and the coupling terminal, the sixth line connecting the fourth line and the isolation terminal, and a ground conductor, shortest distances between the ground conductor and the first and fourth lines being less than shortest distances between the second, third, fifth, and sixth lines and the ground conductor.

10 Claims, 20 Drawing Sheets

DIRECTIONAL COUPLER

CROSS-REFERENCE TO RELATED APPLICATION

This application is based upon and claims the benefit of priority of the prior Japanese Patent Application No. 2017-167771, filed on Aug. 31, 2017, the entire contents of which are incorporated herein by reference.

FIELD

A certain aspect of the present invention relates to a directional coupler.

BACKGROUND

Directional couplers have been used in mobile communication devices. It has been known to form a directional coupler with a layered product having dielectric layers stacked as disclosed in, for example, Japanese Patent Application Publication Nos. 2015-12323 and 2015-109630, U.S. Pat. No. 5,689,217, and U.S. Patent Application Publication No. 2005/0146394.

SUMMARY OF THE INVENTION

According to a first aspect of the present invention, there is provided a directional coupler including: an input terminal; an output terminal; a coupling terminal; an isolation terminal; a main line electrically connected between the input terminal and the output terminal, the main line including a first line, a second line connecting the first line and the input terminal, and a third line connecting the first line and the output terminal; a sub line electrically connected between the coupling terminal and the isolation terminal, the sub line including a fourth line electromagnetically coupled with the first line, a fifth line electromagnetically coupled with the second line, and a sixth line electromagnetically coupled with the third line, the fifth line connecting the fourth line and the coupling terminal, and the sixth line connecting the fourth line and the isolation terminal, and a ground conductor, a shortest distance between the ground conductor and the first line and a shortest distance between the ground conductor and the fourth line being less than a shortest distance between the second line and the ground conductor, a shortest distance between the third line and the ground conductor, a shortest distance between the fifth line and the ground conductor, and a shortest distance between the sixth line and the ground conductor.

According to a second aspect of the present invention, there is provided a directional coupler including: a first dielectric layer; a first main line pattern located on a surface of the first dielectric layer; a first sub line pattern located on the surface of the first dielectric layer, at least a part of the first sub line pattern being located along at least a part of the first main line pattern; a second dielectric layer overlapping with the first dielectric layer; a ground pattern located on a surface of the second dielectric layer and overlapping with the first main line pattern and the first sub line pattern; a third dielectric layer located so as to sandwich the second dielectric layer between the third dielectric layer and the first dielectric layer; a second main line pattern located on a surface of the third dielectric layer and coupled with a first end of the first main line pattern; a second sub line pattern located on the surface of the third dielectric layer and coupled with a first end of the first sub line pattern, at least a part of the second sub line pattern being located along at least a part of the second main line pattern; a third main line pattern located on the surface of the third dielectric layer and coupled with a second end of the first main line pattern; and a third sub line pattern located on the surface of the third dielectric layer and coupled with a second end of the first sub line pattern, at least a part of the third sub line pattern being located along at least a part of the third main line pattern.

DETAILED DESCRIPTION

The directional coupler is desired to have a widely flat coupling degree across frequencies.

Hereinafter, a description will be given of embodiments of the present invention with reference to the accompanying drawings.

First Embodiment

Figure 1:
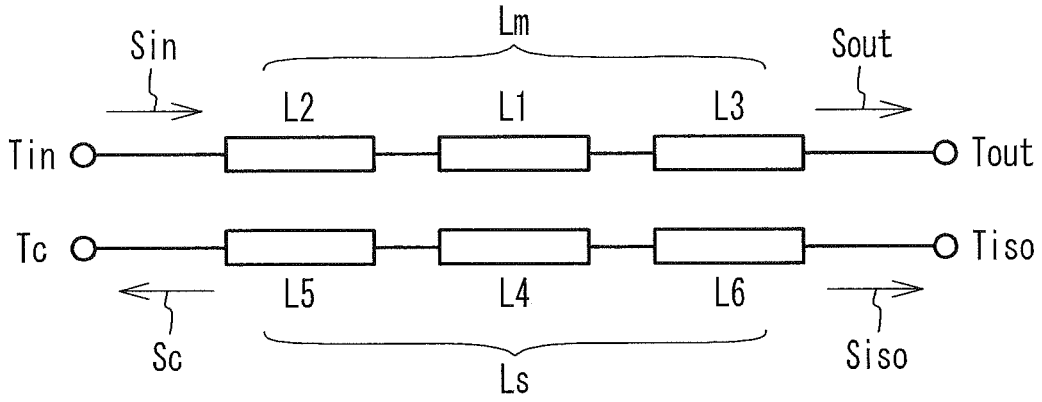
FIG. 1 is a circuit diagram of a directional coupler in accordance with a first embodiment.

FIG. 1 is a circuit diagram of a directional coupler in accordance with a first embodiment. As illustrated in FIG. 1, a main line Lm is connected in series between an input terminal Tin and an output terminal Tout. The main line Lm has a line L1 in the middle, a line L2 electrically connecting the input terminal Tin and the line L1, and a line L3 electrically connecting the line L1 and an output terminal Tout. A sub line Ls is connected between a coupling terminal Tc and an isolation terminal Tiso. The sub line Ls has a line L4 in the middle, a line L5 electrically connecting the coupling terminal Tc and the line L4, and a line L6 electrically connecting the line L4 and the isolation terminal Tiso. The lines L1 through L3 are respectively electromagnetically coupled with the line L4 through L6.

Most of a high-frequency signal Sin input from the input terminal Tin is output as a high-frequency signal Sout from the output terminal Tout. The high-frequency signal propagating through the main line Lm is coupled with the sub line Ls. Thus, a part of the high-frequency signal Sin is output as a high-frequency signal Sc from the coupling terminal Tc. A part of the high-frequency signal Sout is output as a high-frequency signal Siso from the isolation terminal Tiso. The coupling degree (coupling) is defined by the electric power of the signal Sc with respect to the electric power of the signal Sin. The isolation is defined by the electric power of the signal Siso with respect to the electric power of the signal Sin.

The directional coupler is used for, for example, the transmit circuit of a mobile communication device. The directional coupler is used to extract a part of a transmission signal amplified by an amplifier such as a power amplifier and feedback the part of the transmission signal to the power amplifier. This enables control of the power amplifier in real time.

The directional coupler is desired to have a flat coupling degree with respect to frequency. For example, in the Global System for Mobile communications (GSM, registered trademark) 800/900, the transmit band is from 824 to 915 MHz. For example, in this transmit band, the coupling degree is desired to be 20 dB±2 dB. In this example, since the frequency band is 91 MHz, the coupling degree is relatively easily flattened.

However, in recent years, many bands are used in a mobile communication device. Thus, the band for which the directional coupler is used has been broadened, for example, from 698 to 2690 MHz. As the frequency increases, the electromagnetic field coupling is enhanced. Thus, the coupling degree increases. For example, the coupling degree is 30 dB at 698 MHz, and the coupling degree is 17 dB at 2700 MHz.

As described above, the frequency dependence of the coupling degree is desired to be small. That is, the coupling degree is preferably flat with respect to the frequency. The isolation terminal Tiso is terminated with a termination resistor. The signal Siso is consumed by the termination resistor. Thus, the isolation is preferably large.

In the first embodiment, the characteristic impedances of the lines L1 and L4 are configured to be less than the characteristic impedances of the lines L2, L3, L5, and L6. This configuration makes the coupling degree between the lines L1 and L4 less than the coupling degree between the lines L2 and L5 and the coupling degree between the lines L3 and L6. Accordingly, it is considered that the phase difference between the main line Lm and the sub line Ls increases. Therefore, the frequency dependence of the coupling degree decreases, and the isolation improves.

Second Embodiment

Figure 2:
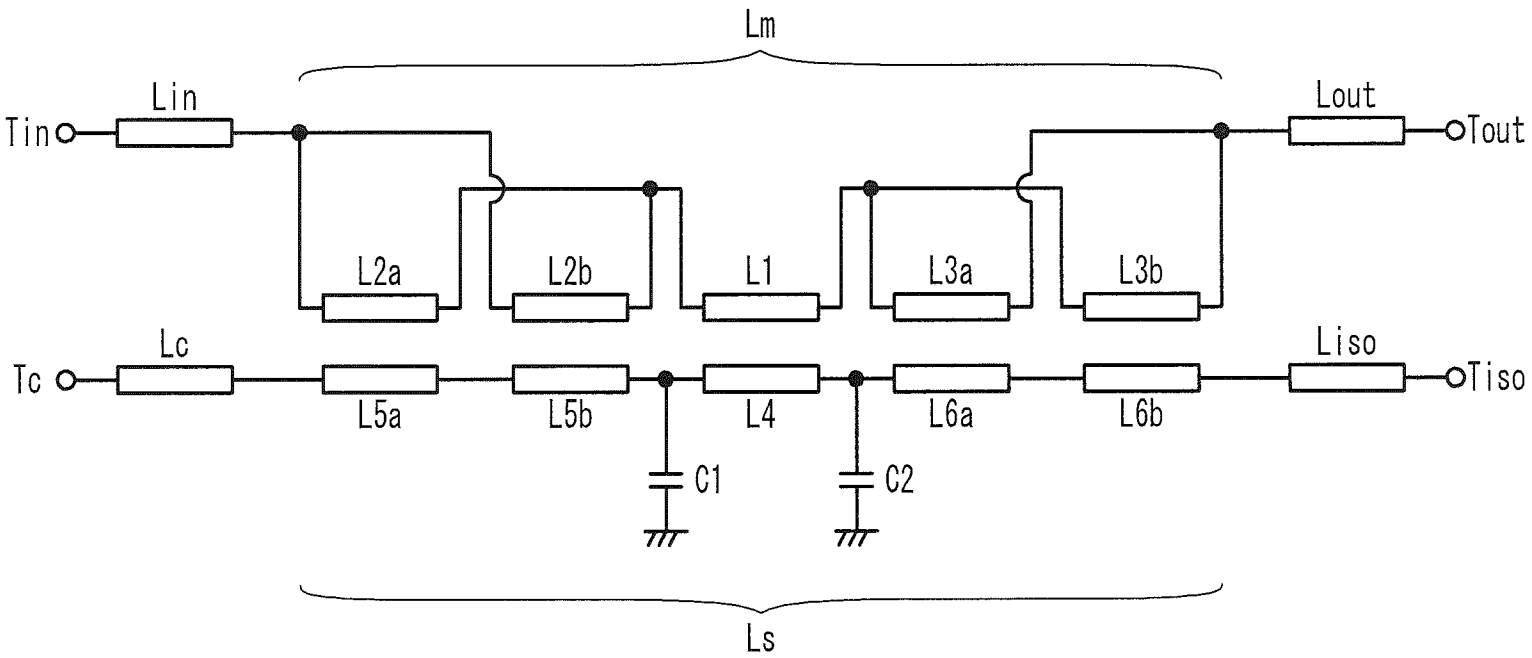
FIG. 2 is a circuit diagram of a directional coupler in accordance with a second embodiment.

A second embodiment is a tangible example of the first embodiment. FIG. 2 is a circuit diagram of a directional coupler in accordance with the second embodiment. As illustrated in FIG. 2, lines L2*a* and L2*b* are connected in parallel between the input terminal Tin and the line L1. Lines L3*a* and L3*b* are connected in parallel between the line L1 and the output terminal Tout. Lines L5*a* and L5*b* are connected in series between the coupling terminal Tc and the line L4. Lines L6*a* and L6*b* are connected in series between the line L4 and the isolation terminal Tiso. The lines L2*a*, L2*b*, L3*a*, and L3*b* are respectively electromagnetically coupled with the lines L5*a*, L5*b*, L6*a*, and L6*b*.

A high-frequency signal mainly propagates through the main line Lm. Thus, the lines L2*a* and L2*b* are connected in parallel, and the lines L3*a* and L3*b* are connected in parallel. This configuration decreases the conductor loss of the main line Lm, thereby decreasing the insertion loss of the main line Lm. The loss of the sub line Ls does not affect the characteristics of the directional coupler much. Thus, the lines L5*a* and L5*b* are connected in series, and the lines L6*a* and L6*b* are connected in series. This configuration makes the coupling degree high.

A line Lin is connected between the input terminal Tin and the main line Lm, and a line Lout is connected between the main line Lm and the output terminal Tout. A line Lc is connected between the coupling terminal Tc and the sub line Ls, and a line Liso is connected between the sub line Ls and the isolation terminal Tiso. The lines Lin, Lout, Lc, and Liso are extraction patterns. A capacitor C1 is connected between a node located between the lines L4 and L5*b* and a ground, and a capacitor C2 is connected between a node located between the lines L4 and L6*a* and a ground. The capacitors C1 and C2 are provided for (finely) adjusting the impedance of the line L4. Other configurations are the same as those of the first embodiment, and the description thereof is thus omitted.

Figure 3A:
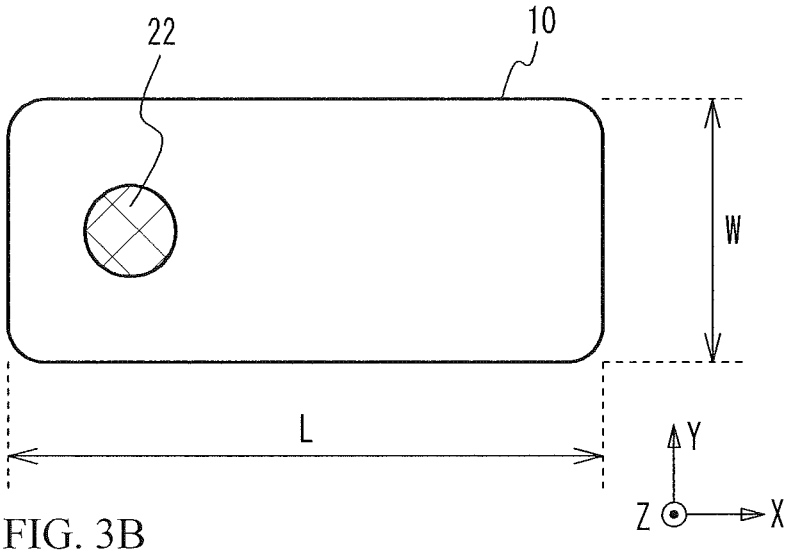
FIG. 3A through FIG. 3C are a top view, a bottom view, and a side view of the directional coupler of the second embodiment, respectively.
Figure 3C:
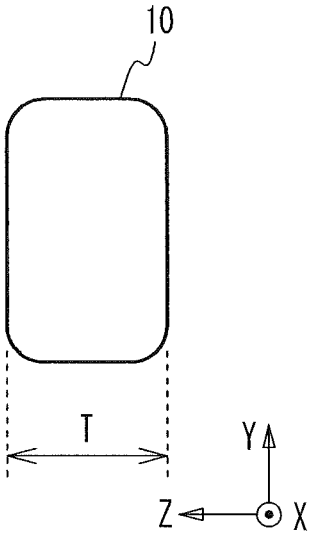
Figure 3B:
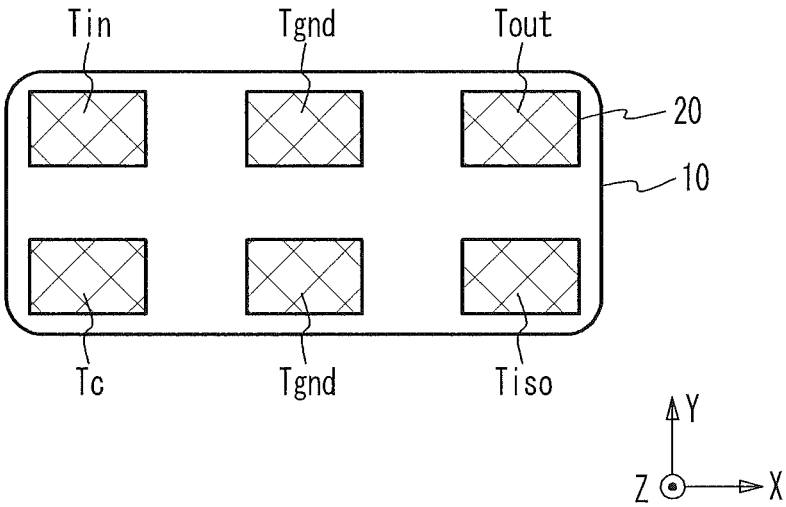

FIG. 3A through FIG. 3C are a top view, a bottom view, and a side view of the directional coupler of the second embodiment, respectively. FIG. 3B illustrates the lower surface of the directional coupler as viewed transparently from above. The stacking direction of a layered body 10 is defined as a Z direction, the longitudinal direction in the surface direction of the layered body 10 is defined as an X direction, and a short direction is defined as a Y direction.

As illustrated in FIG. 3A through FIG. 3C, the directional coupler has the layered body 10. An orientation identification mark 22 is provided on the upper surface of the layered body 10. Terminal electrodes 20 are located on the lower surface of the layered body 10. The terminal electrodes 20 correspond to the input terminal Tin, the output terminal Tout, the coupling terminal Tc, the isolation terminal Tiso, and the ground terminal Tgnd. The length L of the layered body 10 in the X direction is, for example, 1 mm, the width W in the Y direction is, for example, 0.5 mm, and the thickness T in the Z direction is, for example, 0.45 mm.

Figure 4:
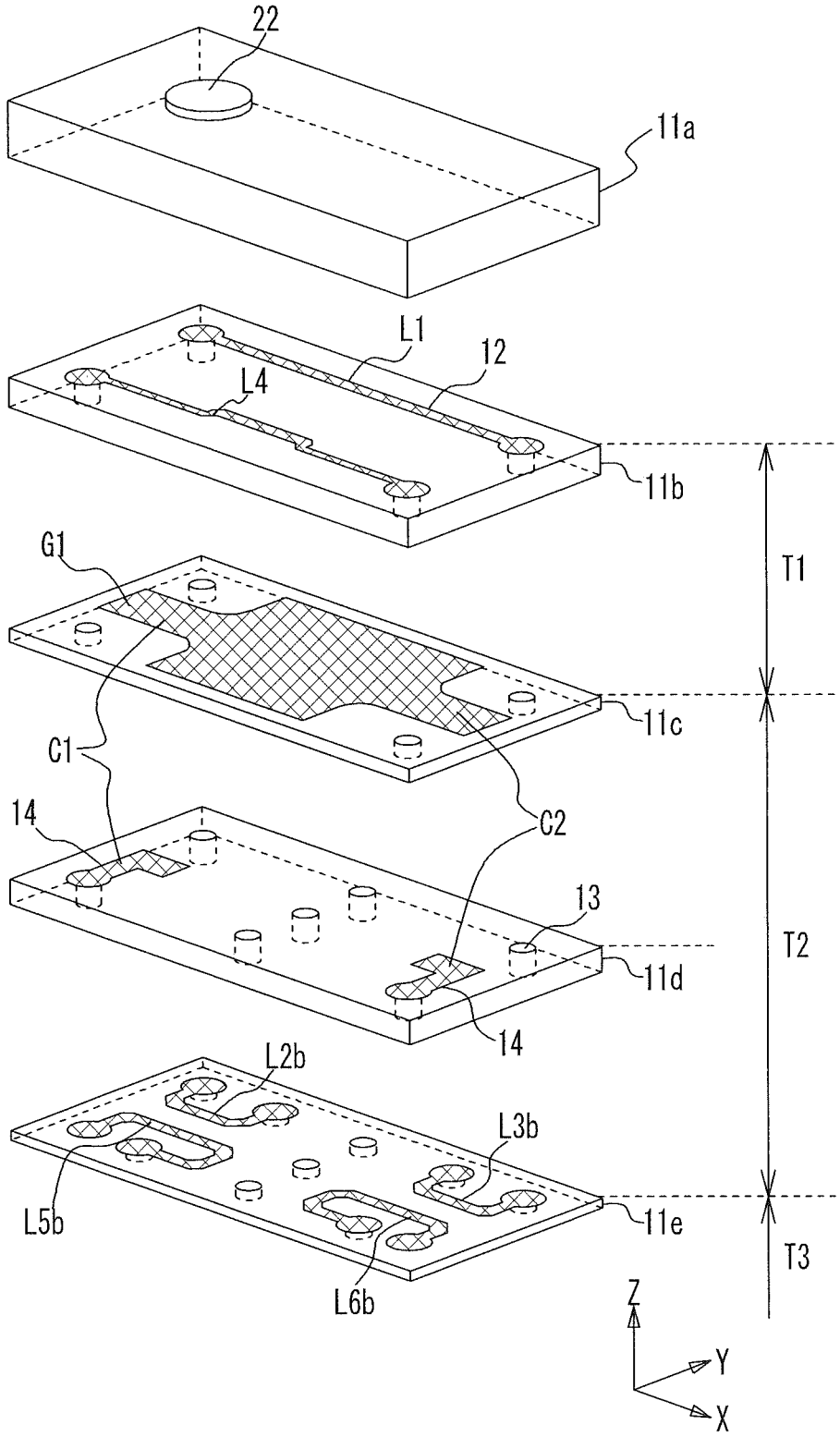
FIG. 4 is an exploded perspective view (No. 1) of the directional coupler in the second embodiment.
Figure 5:
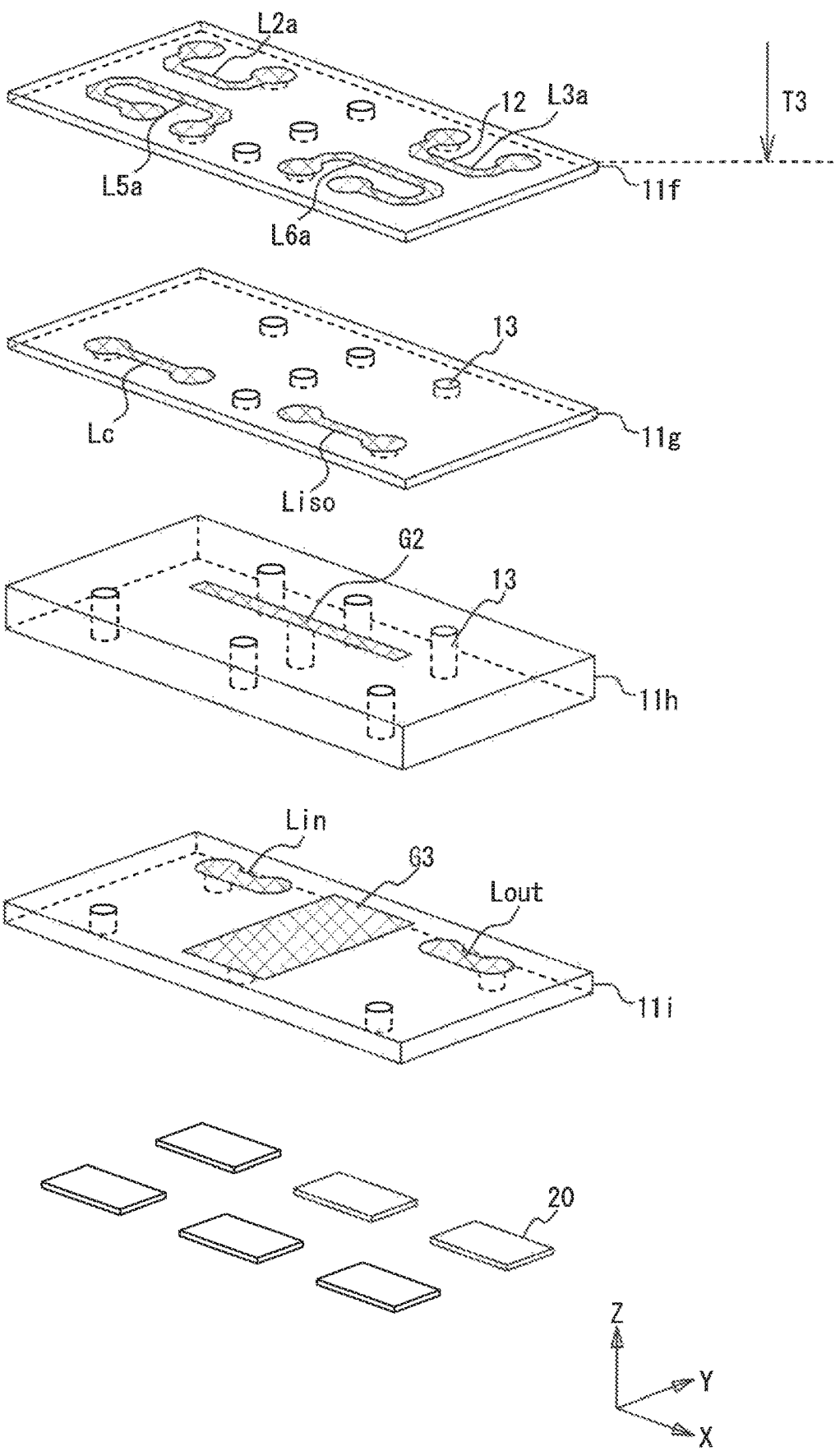
FIG. 5 is an exploded perspective view (No. 2) of the directional coupler in the second embodiment.

FIG. 4 and FIG. 5 are exploded perspective views of the directional coupler in the second embodiment. FIG. 6A through FIG. 9E are plan views of respective dielectric layers in the second embodiment. FIG. 6A, FIG. 6C, FIG. 7A, FIG. 7C, FIG. 8A, FIG. 8C, FIG. 9A, and FIG. 9C illustrate conductor patterns 12 on the upper surfaces of dielectric layers 11*b* through 11 *i*, respectively. FIG. 6B, FIG. 6D, FIG. 7B, FIG. 7D, FIG. 8B, FIG. 8D, FIG. 9B, and FIG. 9D illustrate via wirings 13 penetrating through the dielectric layers 11*b* through 11*i*, respectively. FIG. 9E illustrates the terminal electrodes 20 on the lower surface of the dielectric layer 11*i*, and illustrates the lower surface of the dielectric layer 11*i* as transparently viewed from above.

As illustrated in FIG. 4 through FIG. 9E, dielectric layers 11*a* through 11*i* are stacked. The conductor patterns 12 are formed on the upper surfaces of the dielectric layers 11*b* through 11*i*. The terminal electrodes 20 are formed on the lower surface of the dielectric layer 11*i*. The via wirings 13 penetrating through the dielectric layers 11*b* through 11*i* are formed in the dielectric layers 11*b* and 11*i*. The via wiring 13 electrically connects the upper and lower conductor patterns 12. The dielectric layers 11*a* through 11*i* are made of, for example, ceramic materials containing oxide of Al, Si and/or Ca. The dielectric layers 11*a* through 11*i* may be made of resin materials or glass materials. The conductor patterns 12 and the via wirings 13 are formed of, for example, metal layers made of Ag, Pd, Pt, Cu, Ni, Au, Au—Pd alloy, or Ag—Pt alloy.

Figure 6A:
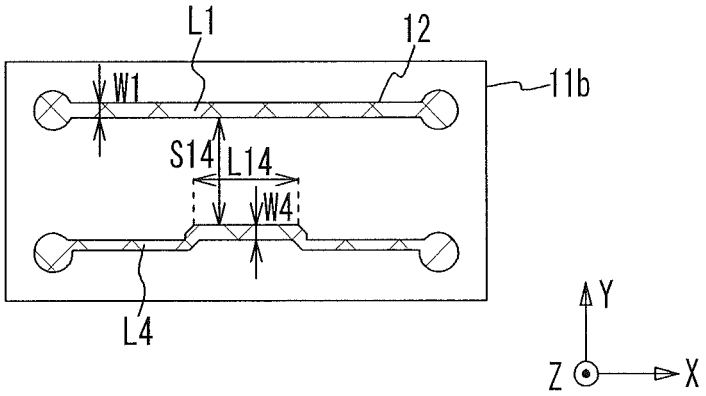
FIG. 6A through FIG. 6D are plan views (No. 1) of individual dielectric layers in the second embodiment.
Figure 6B:
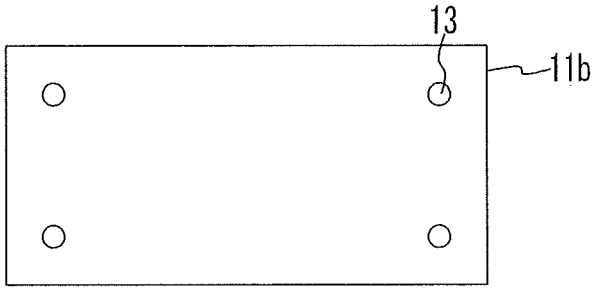

As illustrated in FIG. 4, the orientation identification mark 22 is formed on the upper surface of the dielectric layer 11*a*. As illustrated in FIG. 4 and FIG. 6A, the conductor pattern 12 on the dielectric layer 11*b* forms the lines L1 and L4. The lines L1 and L4 extend in the X direction, and are arranged substantially in parallel. The line L1 is substantially linear. The middle part of the line L4 is shifted in the +Y direction from both end parts of the line L4. As illustrated in FIG. 6A, in the region where the line L1 and the middle part of the line L4 face each other, the width of the line L1 is represented by W1, the width of the line L4 is represented by W4, the distance between the lines L1 and L4 is represented by S14, and the lengths of the lines L1 and L4 are represented by L14.

Figure 6C:
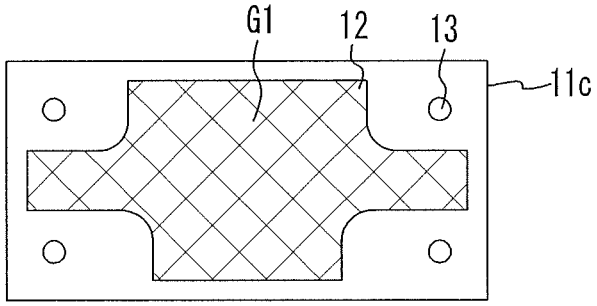
Figure 6D:
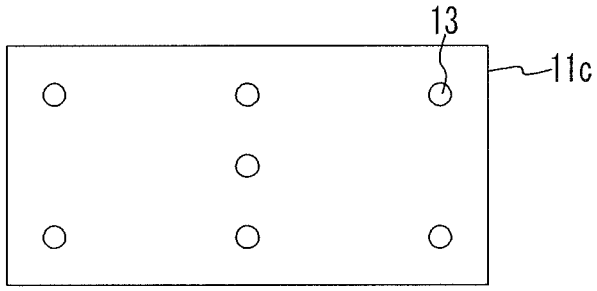

As illustrated in FIG. 4 and FIG. 6C, the conductor pattern 12 on the upper surface of the dielectric layer 11*c* forms a ground electrode G1. In plan view, a part of the line L1 and a part of the line L4 (the region including the region where the line L4 is shifted in the +Y direction) overlap with the ground electrode G1. The lines L1 and the ground electrode G1 form a microstripline, and the line L4 and the ground electrode G1 form a microstripline. When there is no limitation for height, the lines L1 and L4 may be signal lines of striplines.

Figure 7A:
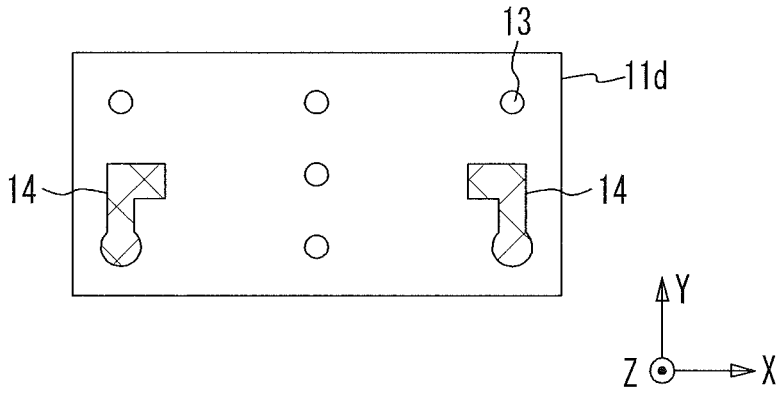
FIG. 7A through FIG. 7D are plan views (No. 2) of individual dielectric layers in the second embodiment.
Figure 7B:
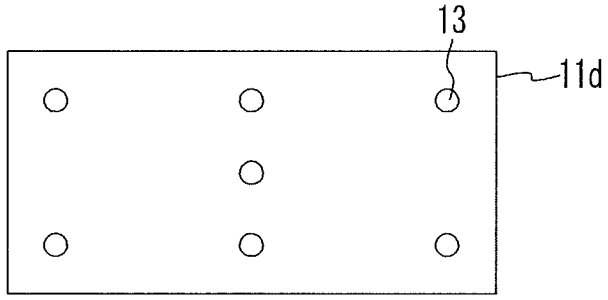

As illustrated in FIG. 4 and FIG. 7A, the conductor pattern 12 on the upper surface of the dielectric layer 11*d* forms capacitor electrodes 14. The capacitor electrodes 14 and the ground electrode G1 facing each other across the dielectric layer 11*c* form the capacitors C1 and C2.

Figure 7C:
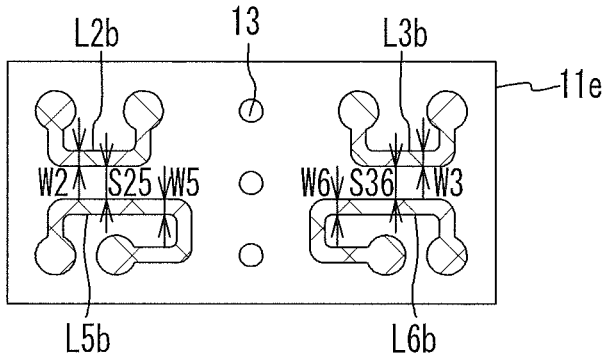
Figure 7D:
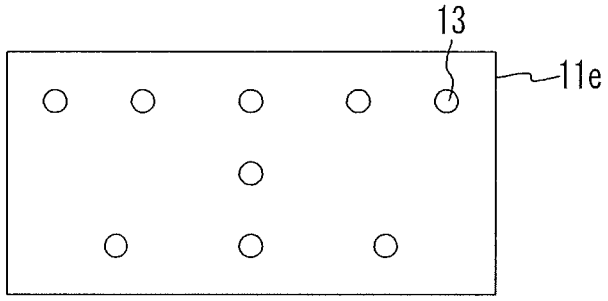

As illustrated in FIG. 4 and FIG. 7C, the conductor pattern 12 on the upper surface of the dielectric layer 11*e* forms the lines L2*b*, L3*b*, L5*b*, and L6*b*. The lines L2*b*, L3*b*, L5*b*, and L6*b* have a U-shape or a C-shape. The lines L2*b*, L3*b*, L5*b*, and L6*b* may have a meander shape. To prevent the reduction in impedance, in plan view, none of the lines L2*b*, L3*b*, L5*b*, and L6*b* overlaps with the ground electrode G1.

Figure 8A:
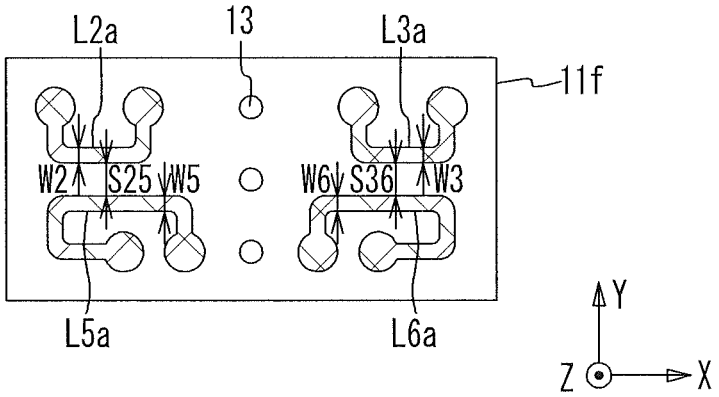
FIG. 8A through FIG. 8D are plan views (No. 3) of individual dielectric layers in the second embodiment.
Figure 8B:
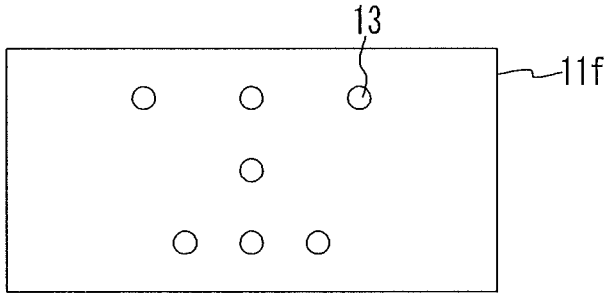

As illustrated in FIG. 5 and FIG. 8A, the conductor pattern 12 on the upper surface of the dielectric layer 11*f* forms the lines L2*a*, L3*a*, L5*a*, and L6*a*. The lines L2*a*, L3*a*, L5*a*, and L6*a* have a U-shape and a C-shape. In plan view, none of the lines L2*a*, L3*a*, L5*a*, and L6*a* overlaps with the ground electrode G1. In plan view, the lines L2*a*, L3*a*, L5*a*, and L6*a* respectively overlap with at least parts of the lines L2*b*, L3*b*, L5*b*, and L6*b*. The lines L5*a* and L5*b* are wound in the same direction, and the lines L6*a* and L6*b* are wound in the same direction.

As illustrated in FIG. 7C and FIG. 8A, the width of each of the lines L2*a* and L2*b* is represented by W2, the width of each of the lines L3*a* and L3*b* is represented by W3, the width of each of the lines L5*a* and L5*b* is represented by W5, and the width of each of the lines L6*a* and L6*b* is represented by W6. The distance between the lines L2*a* and L5*a* and the distance between the lines L2*b* and L5*b* are represented by S25. The distance between the lines L3*a* and L6*a* and the distance between the lines L3*b* and L6*b* are represented by S36.

Figure 8C:
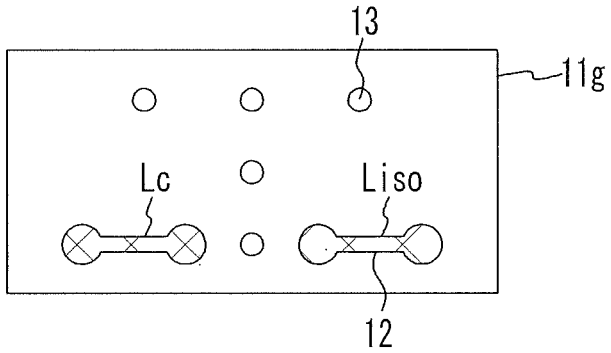
Figure 8D:
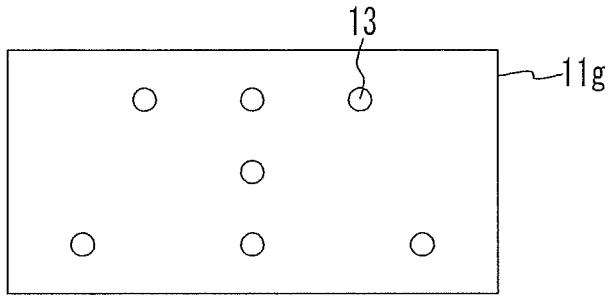
Figure 9A:
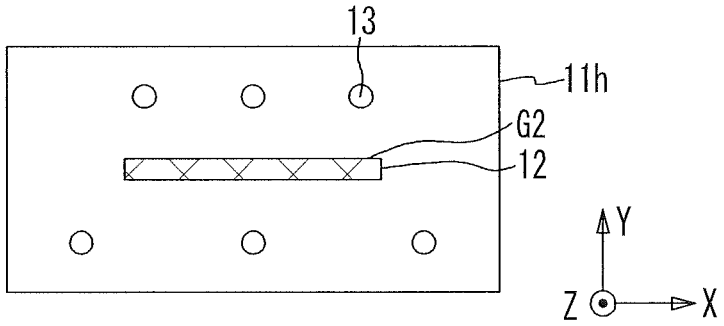
FIG. 9A through FIG. 9E are plan views (No. 4) of individual dielectric layers in the second embodiment.
Figure 9B:
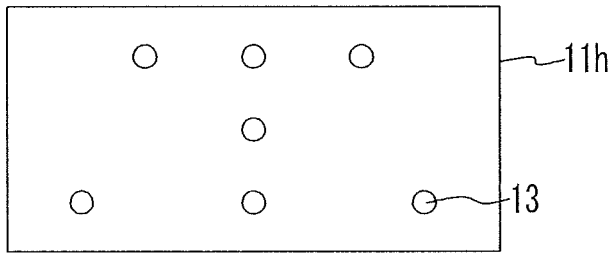
Figure 9C:
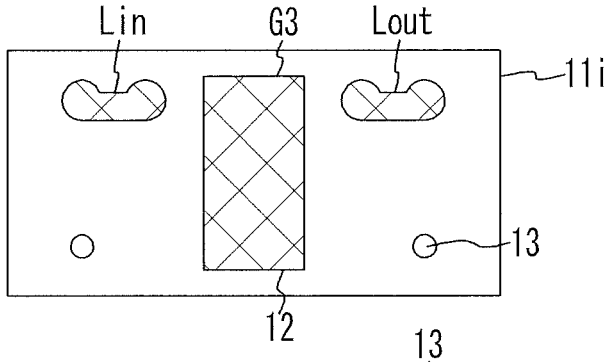
Figure 9D:
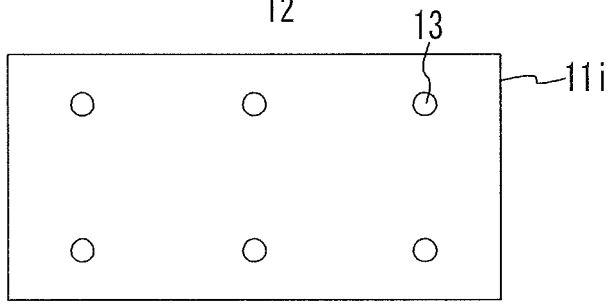
Figure 9E:
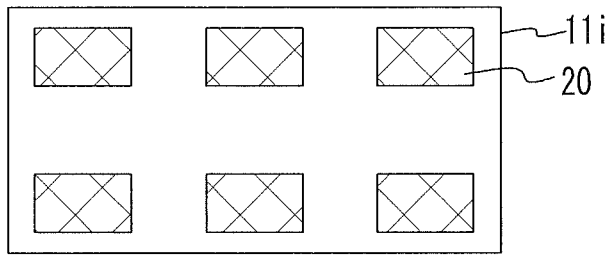

As illustrated in FIG. 5 and FIG. 8C, the conductor pattern 12 on the upper surface of the dielectric layer 11*g* forms the lines Lc and Liso. As illustrated in FIG. 5 and FIG. 9A, the conductor pattern 12 on the upper surface of the dielectric layer 11*h* forms a ground electrode G2. As illustrated in FIG. 5 and FIG. 9C, the conductor pattern 12 on the upper surface of the dielectric layer 11*i* forms the lines Lin and Lout and a ground electrode G3. As illustrated in FIG. 5 and FIG. 9E, the terminal electrodes 20 are formed on the lower surface of the dielectric layer 11*i*. As illustrated in FIG. 6B, FIG. 6D, FIG. 7B, FIG. 7D, FIG. 8B, FIG. 8D, FIG. 9B, and FIG. 9D, the via wirings 13 are formed in the dielectric layers 11*b* through 11*i*.

As illustrated in FIG. 4 and FIG. 5, the thickness of the dielectric layer 11*b* between the lines L1 and L4 and the ground electrode G1 is represented by T1, the total thickness of the dielectric layers 11*c* and 11*d* between the ground electrode G1 and the lines L2*b*, L3*b*, L5*b*, and L6*b* is represented by T2, and the thickness of the dielectric layer 11*e* between the lines L2*b*, L3*b*, L5*b*, and L6*b* and the lines L2*a*, L3*a*, L5*a*, and L6*a* is represented by T3. In addition, the thickness of each of the lines L1 and L4 is represented by T4, and the thicknesses of the lines L2*a*, L2*b*, L3*a*, L3*b*, L5*a*, L5*b*, L6*a*, and L6*b* are represented by T5.

Simulation 1

A simulation was conducted for various thicknesses T1 through T5. A simulation 1 was a circuit simulation with use of the advanced design system (ADS) available from the Keysight Technologies, Inc.

The simulation conditions are as follows.

Relative permittivity of each of the dielectric layers 11*a* through 11*i*: 10

Width W1 of the line L1: 25 μm

Width W4 of the line L4: 20 μm

Distance S14 between the lines L1 and L4: 230 μm

Length L14 along which the lines L1 and L4 face each other: 785 μm

Width W2 of each of the lines L2*a* and L2*b*: 25 μm

Width W3 of each of the lines L3*a* and L3*b*: 25 μm

Width W5 of each of the lines L5*a* and L5*b*: 25 μm

Width W6 of each of the lines L6*a* and L6*b*: 25 μm

Distance S25 between the lines L2*a* and L5*a*: 25 μm

Distance S36 between the lines L3*a* and L6*a*: 25 μm

Table 1 lists the thicknesses T1 through T5 of each of samples A through E with different thicknesses T1 through T5.

TABLE 1

| Sample | T1 (μm) | T2 (μm) | T3 (μm) | T4 (μm) | T5 (μm) |
|---|---|---|---|---|---|
| A | 200 | 200 | 8 | 8 | 8 |
| B | 15 | 200 | 8 | 8 | 8 |
| C | 200 | 15 | 8 | 8 | 8 |
| D | 15 | 200 | 8 | 15 | 8 |
| E | 15 | 200 | 8 | 8 | 15 |

Figure 10:
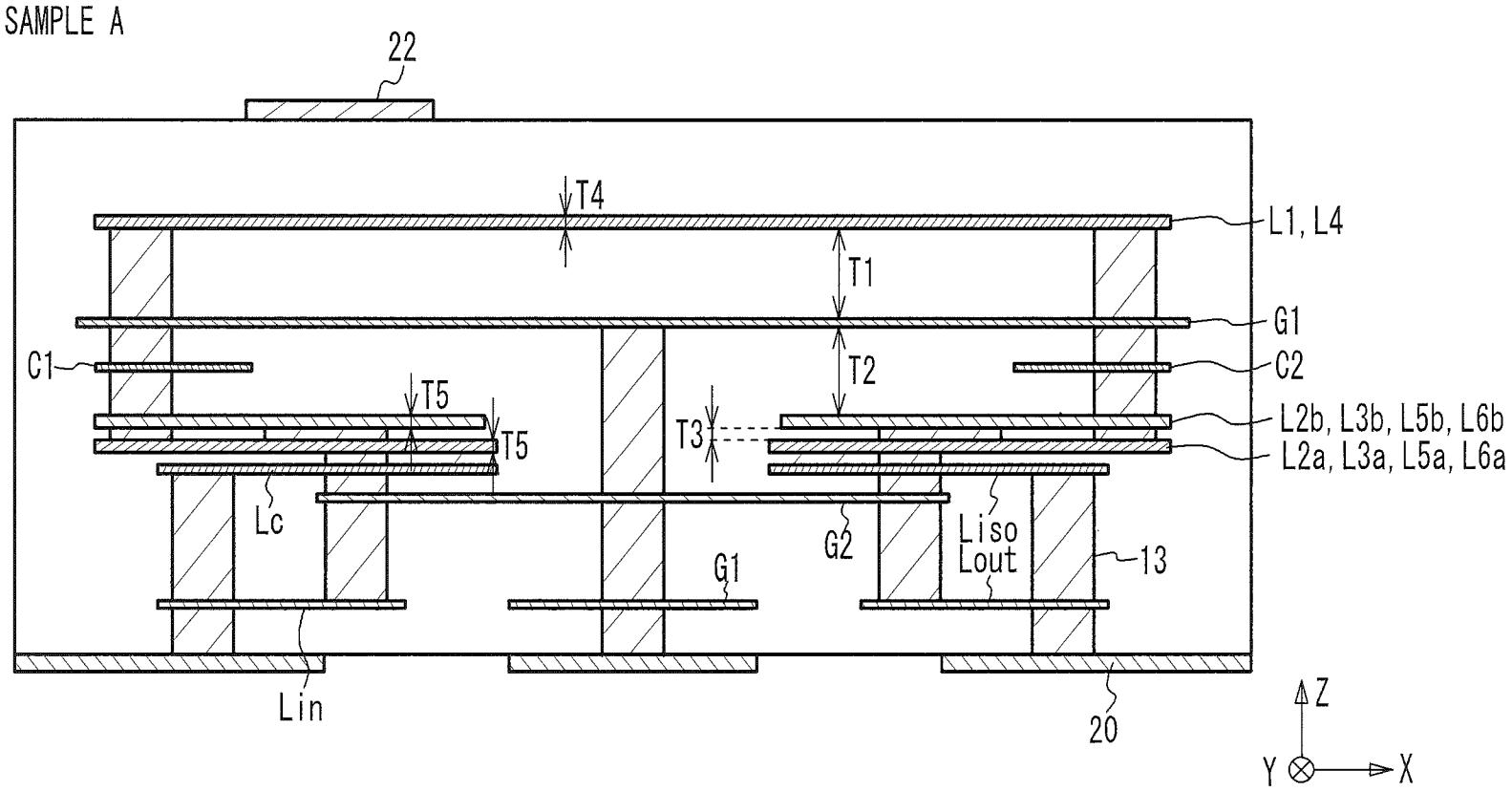
FIG. 10 is a side view of a sample A.
Figure 11:
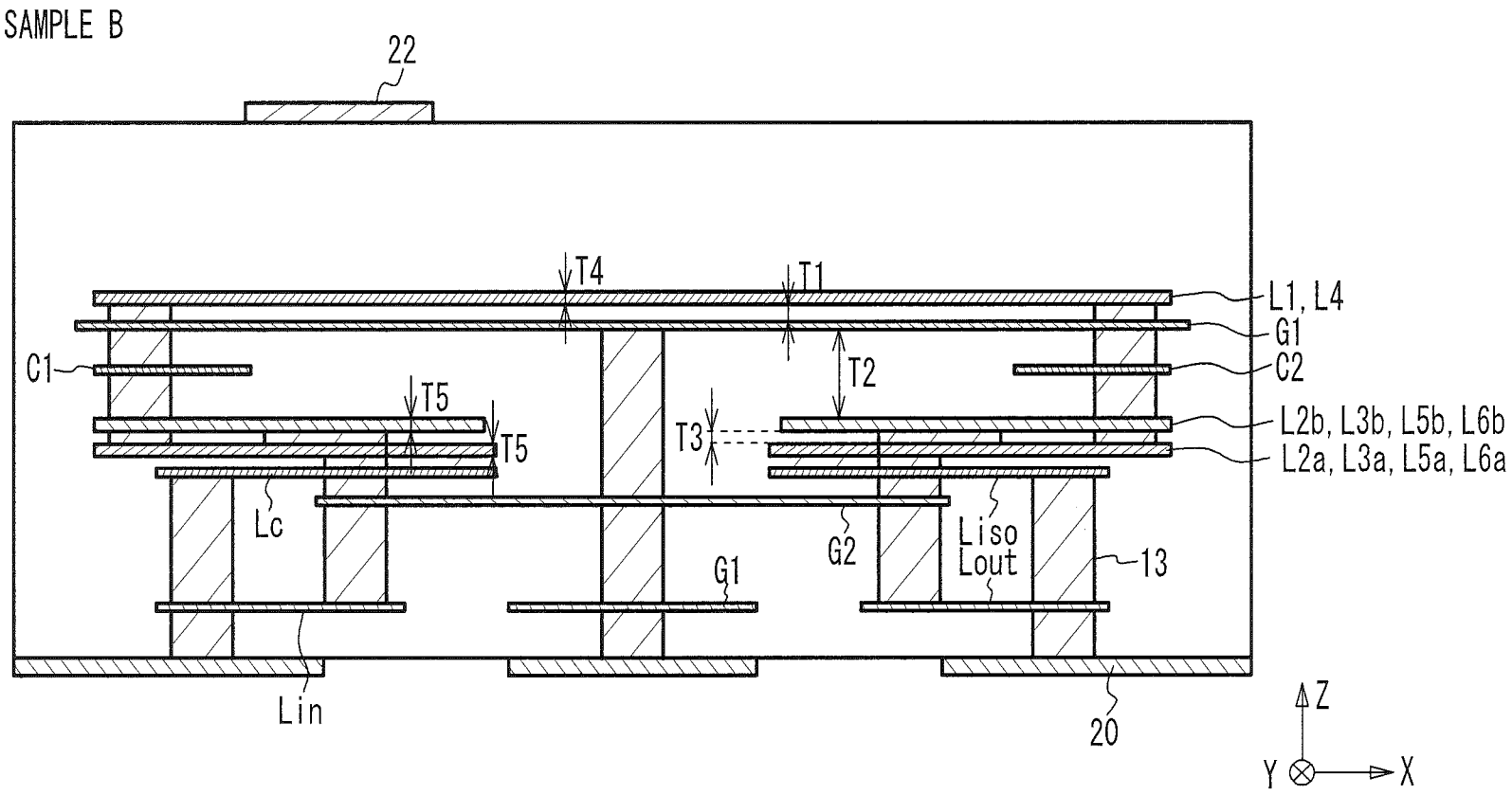
FIG. 11 is a side view of a sample B.
Figure 12:
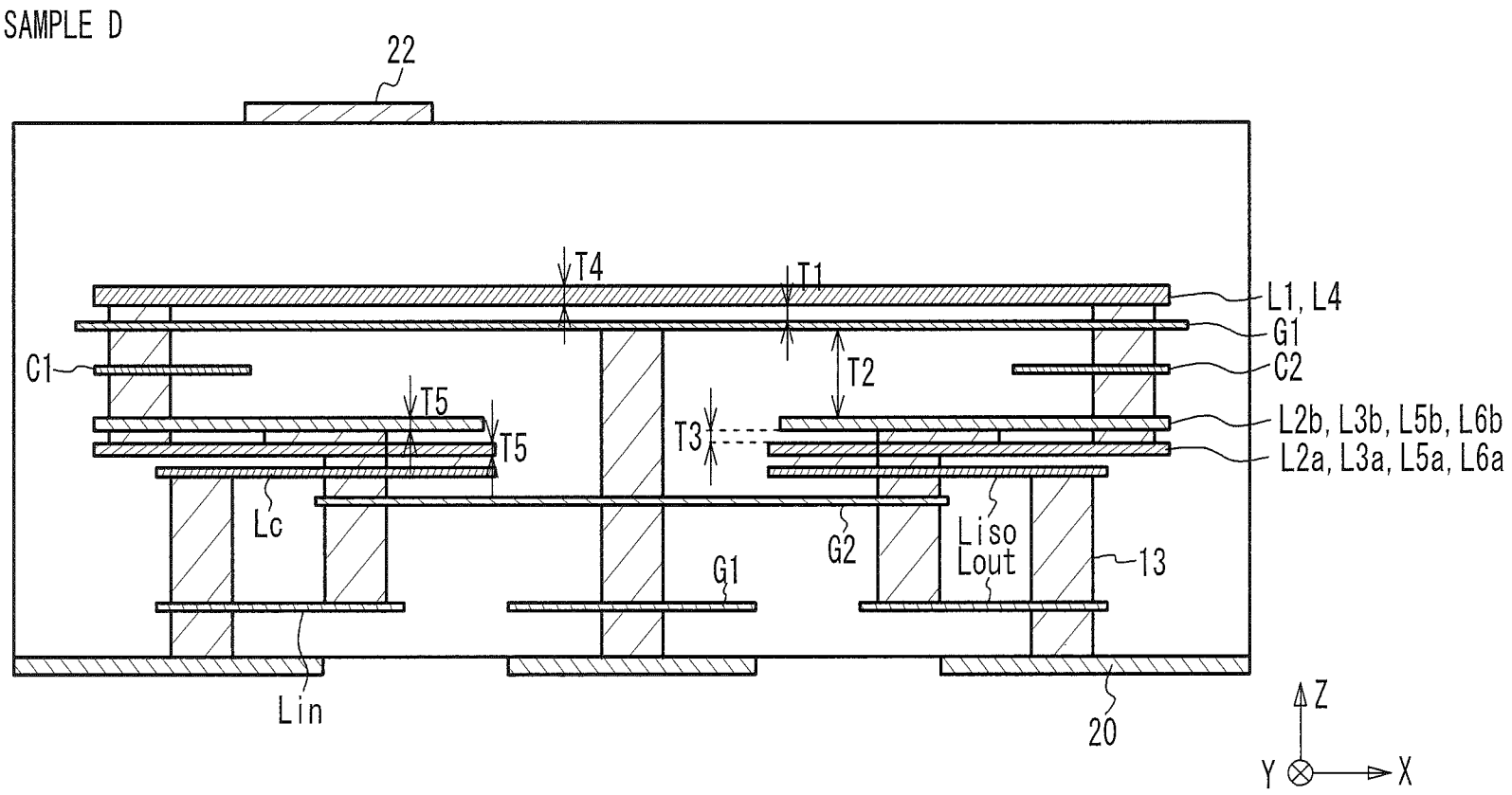
FIG. 12 is a side view of a sample D.

FIG. 10 through FIG. 12 are side views of the samples A, B, and D, respectively, and illustrate the conductor patterns 12 and the via wirings 13 by omitting the illustration of the dielectric layer.

As presented in FIG. 10 and Table 1, in the sample A, the thickness T1 of the dielectric layer 11*b* between the lines L1 and L4 and the ground electrode G1 and the total thickness T2 of the dielectric layers 11*c* and 11*d* between the ground electrode G1 and the lines L2*b*, L3*b*, L5*b*, and L6*b* are 200 μm, and are the same. The thickness T4 of each of the lines L1 and L4 and the thickness T5 of the ground electrode G1 are 8 μm and are the same.

As presented in FIG. 11 and Table 1, in the sample B, the thickness T1 is 15 μm, the thickness T2 is 200 μm, and the thickness T1 is less than the thickness T2. The thickness T4 and the thickness T5 are 8 μm and are the same.

As presented in Table 1, in the sample C, the thickness T1 is 200 μm, the thickness T2 is 15 μm, and the thickness T1 is greater than the thickness T2. The thickness T4 and the thickness T5 are 8 μm and the same.

As presented in FIG. 12 and Table 1, in the sample D, the thickness T1 is 15 μm, the thickness T2 is 200 μm, and the thickness T1 is less than the thickness T2. The thickness T4 is 15 μm, the thickness T5 is 8 μm, and the thickness T4 is greater than the thickness T5.

As presented in Table 1, in the sample E, the thickness T1 is 15 μm, the thickness T2 is 200 μm, and the thickness T1 is less than the thickness T2. The thickness T4 is 8 μm, the thickness T5 is 15 μm, and the thickness T4 is less than the thickness T5.

Figure 13A:
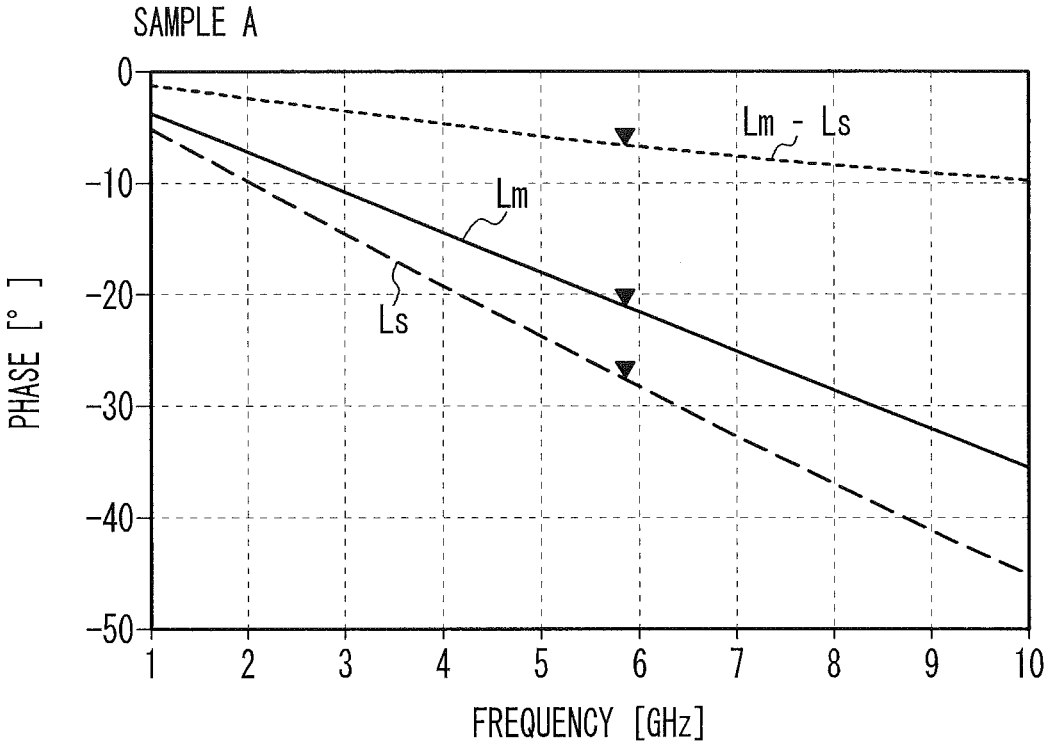
FIG. 13A is a graph of phase versus frequency in the sample A.
Figure 13B:
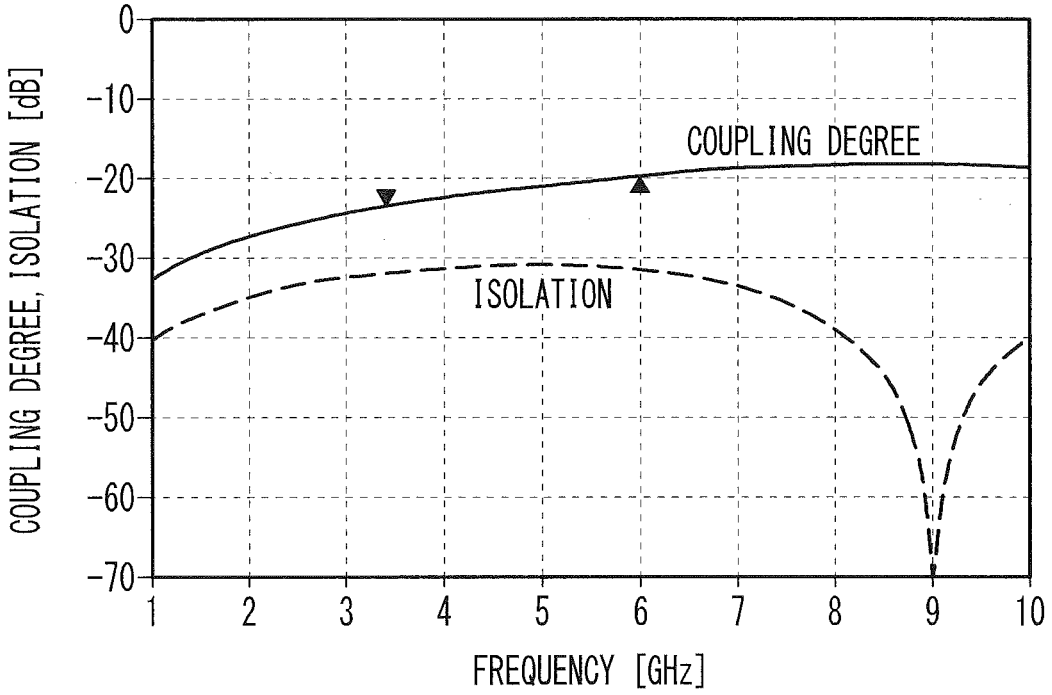
FIG. 13B is a graph of a coupling degree and isolation versus frequency in the sample A.

FIG. 13A is a graph of phase versus frequency in the sample A, and FIG. 13B is a graph of the coupling degree and the isolation versus frequency in the sample A. In FIG. 13A, the solid line indicates the phase of the output terminal Tout with respect to the input terminal Tin in the main line Lm, and the dashed line indicates the phase of the output terminal Tout with respect to the input terminal Tin in the sub line Ls. The dotted line indicates the phase difference Lm−Ls between the main line Lm and the sub line Ls. In FIG. 13B, the solid line indicates the coupling degree, and the dashed line indicates the isolation.

Table 2 lists the phase difference, the difference in coupling degree, and minimum isolation in the samples A through E.

TABLE 2

| Sample | Phase difference [°] | Difference in coupling degree [dB] | Minimum isolation [dB] |
|---|---|---|---|
| A | 6.60 | 3.85 | −31 |
| B | 7.28 | 3.51 | −43 |
| C | 2.79 | 3.98 | −33 |
| D | 7.34 | 3.38 | −43 |
| E | 6.70 | 3.64 | −40 |

The phase difference is the phase difference Lm−Ls between the main line Lm and the sub line Ls at 5.85 GHz (triangle markers in FIG. 13A). The difference in coupling degree is a difference between the coupling degree at 3.4 GHz (an inverted triangle in FIG. 13B) and the coupling degree at 6 GHz (a triangle in FIG. 13B). The minimum isolation is the minimum isolation (the smallest absolute value) in the range from 3.4 GHz to 6 GHz. In the sample A, the phase difference is 6.6°, the difference in coupling degree is 3.85 dB, and the minimum isolation is −31 dB.

Figure 14A:
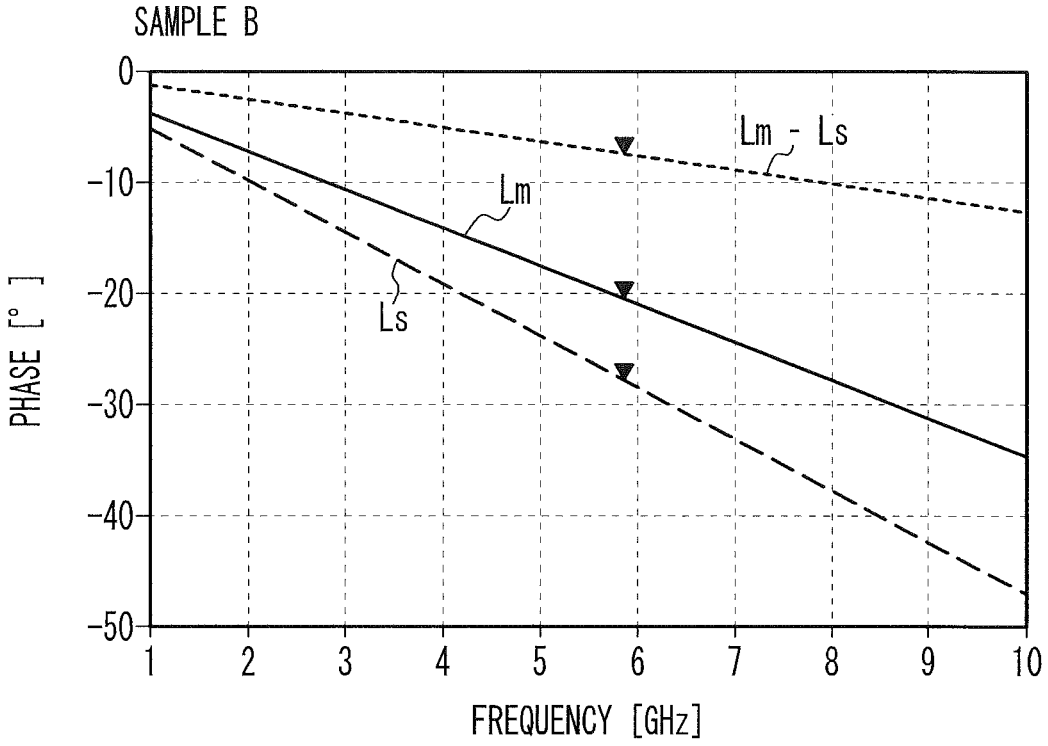
FIG. 14A is a graph of phase versus frequency in the sample B.
Figure 14B:
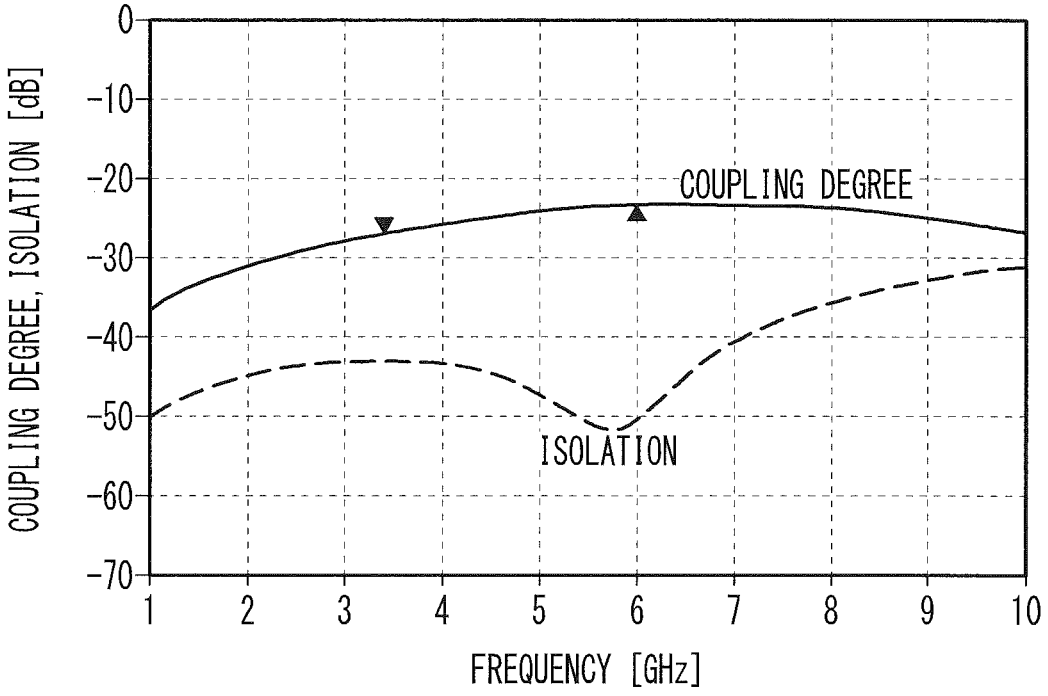
FIG. 14B is a graph of a coupling degree and isolation versus frequency in the sample B.

FIG. 14A is a graph of phase versus frequency in the sample B, and FIG. 14B is a graph of the coupling degree and the isolation versus frequency in the sample B. As illustrated in FIG. 14A, the absolute value of the phase of the main line Lm of the sample B is less than the absolute value of the phase of the main line Lm of the sample A in FIG. 13A. Accordingly, the phase difference of the sample B is greater than the phase difference of the sample A. As presented in Table 2, the phase difference of the sample B is 7.28°.

As illustrated in FIG. 14B, the isolation of the sample B is greater than the isolation of the sample A in FIG. 13B. As presented in Table 2, the difference in coupling degree of the sample B is 3.51 dB, which is less than the difference in coupling degree of the sample A. The minimum isolation of the sample B is −43 dB, which is greater than the minimum isolation of the sample A.

When the thickness T1 is made to be less than the thickness T2 as in the sample B, the phase difference increases. The difference in coupling degree decreases, and the isolation increases. As described above, the difference in coupling degree and the isolation are improved.

Figure 15A:
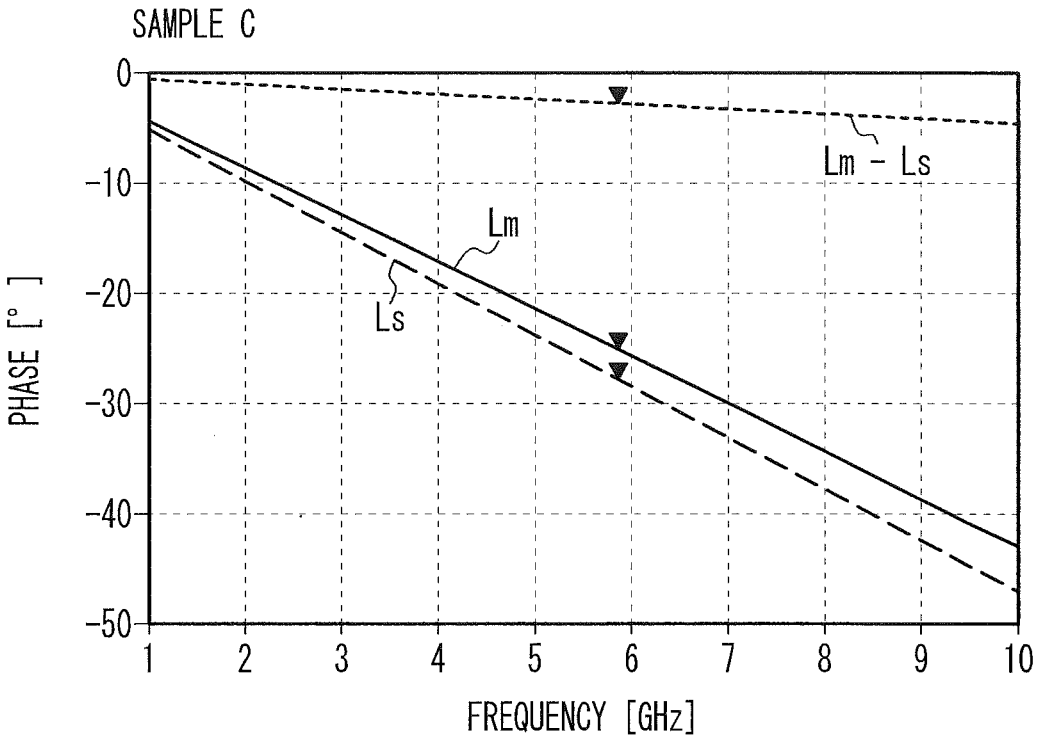
FIG. 15A is a graph of phase versus frequency in the sample C.
Figure 15B:
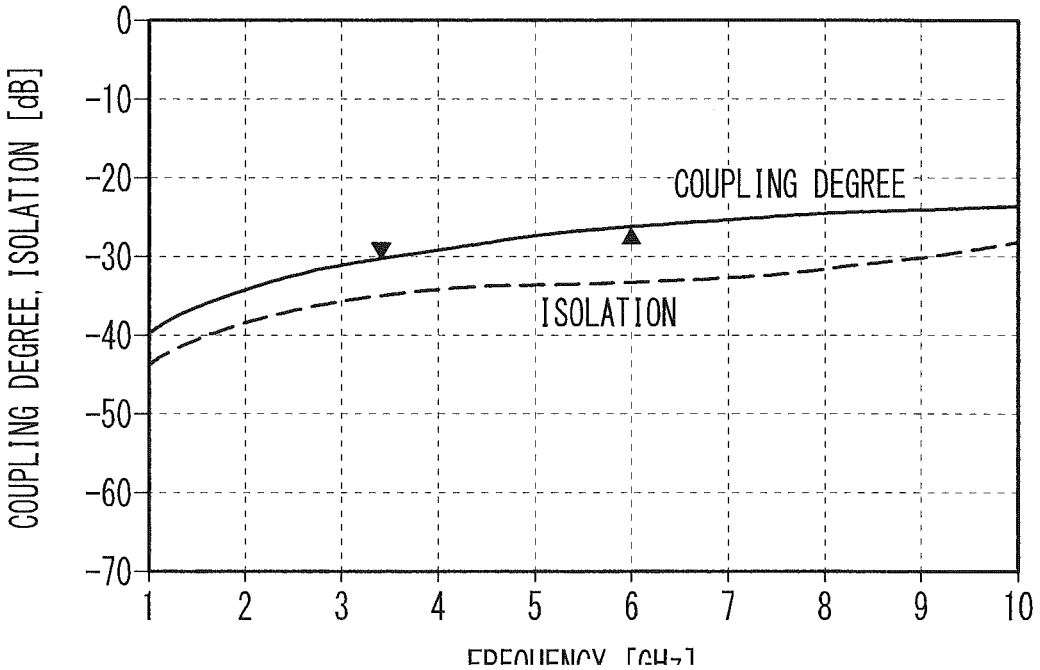
FIG. 15B is a graph of a coupling degree and isolation versus frequency in the sample C.

FIG. 15A is a graph of phase versus frequency in the sample C, and FIG. 15B is a graph of the coupling degree and the isolation versus frequency in the sample C. As illustrated in FIG. 15A, the absolute value of the phase of the main line Lm in the sample C is greater than the absolute value of the phase of the main line Lm in the sample A in FIG. 13A. Accordingly, the phase difference of the sample C is greater than the phase difference of the sample A. As presented in Table 2, the phase difference of the sample C is 2.79°.

As illustrated in FIG. 15B, the isolation of the sample C is less than the isolation of the sample A in FIG. 13B. As presented in Table 2, the difference in coupling degree of the sample C is 3.98 dB, which is greater than that of the sample A. The minimum isolation of the sample C is −33 dB, which is approximately equal to that of the sample A.

When the thickness T2 is made to be less than the thickness T1 as in the sample C, the phase difference decreases. The difference in coupling degree increases, and the isolation is in the same range. As described above, the difference in coupling degree deteriorates.

Figure 16A:
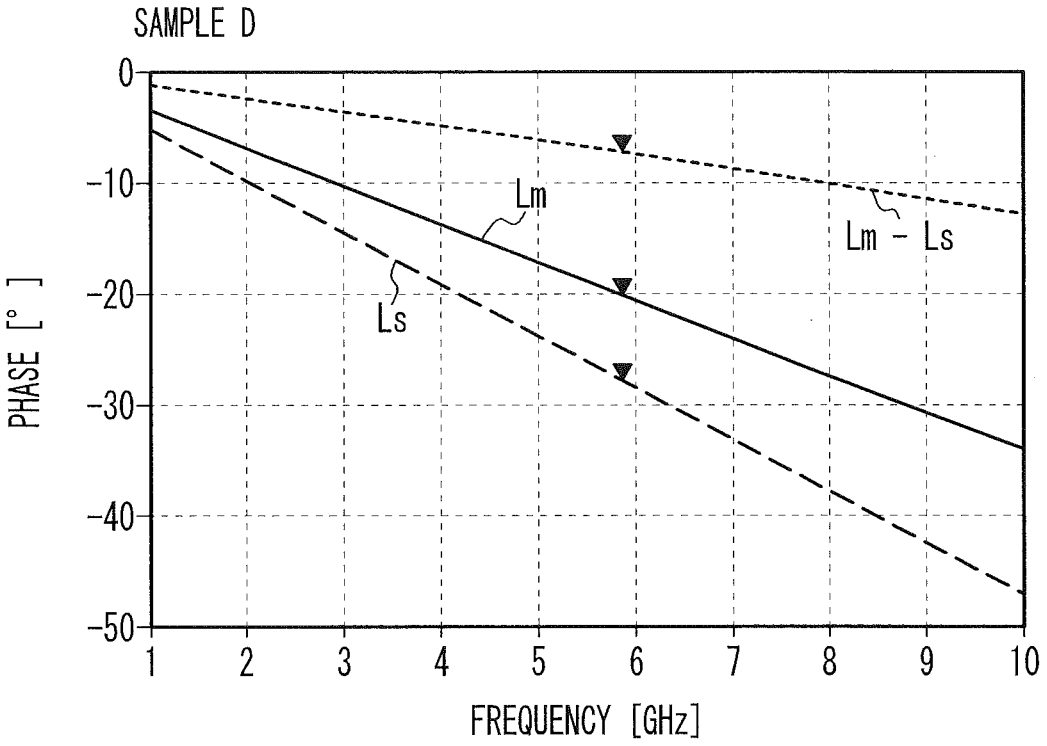
FIG. 16A is a graph of phase versus frequency in the sample D.
Figure 16B:
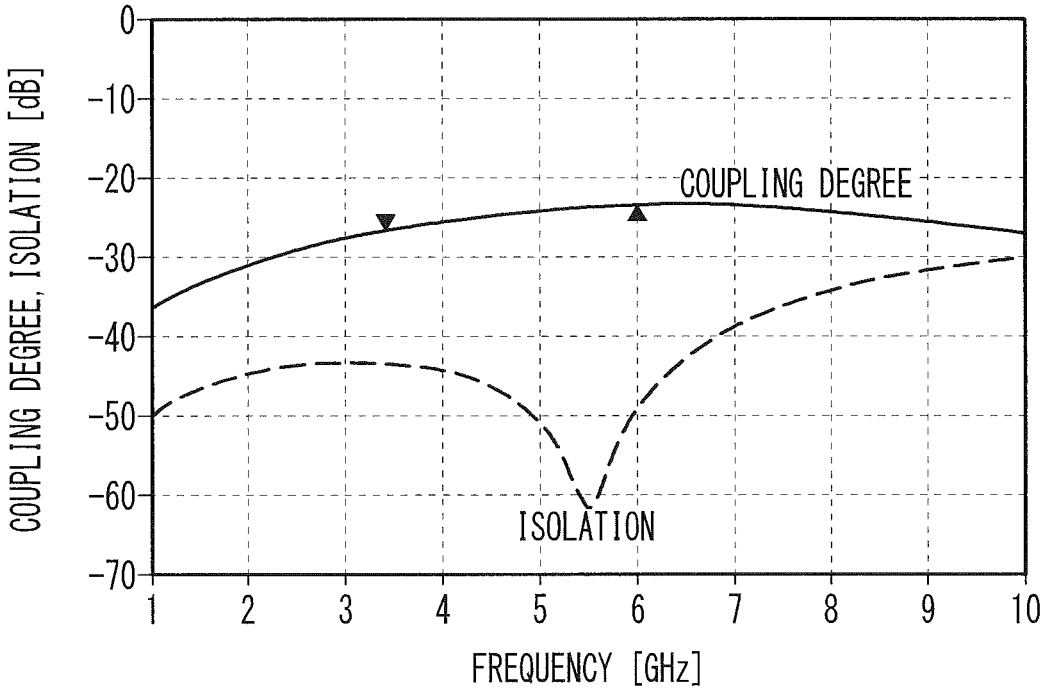
FIG. 16B is a graph of a coupling degree and isolation versus frequency in the sample D.

FIG. 16A is a graph of phase versus frequency in the sample D, and FIG. 16B is a graph of the coupling degree and the isolation versus frequency in the sample D. As presented in FIG. 16A, the phase difference of the sample D is greater than the phase difference of the sample B. As presented in Table 2, the phase difference of the sample D is 7.34°.

As presented in FIG. 16B, the isolation of the sample D is approximately equal to the isolation of the sample B in FIG. 14B. As presented in Table 2, the difference in coupling degree of the sample D is 3.38 dB, which is less than that of the sample B. The minimum isolation of the sample D is −43 dB, which is approximately equal to that of the sample B.

When the thickness T4 is made to be greater than the thickness T5 as in the sample D, the phase difference increases. The difference in coupling degree decreases. As described above, the difference in coupling degree improves.

Figure 17A:
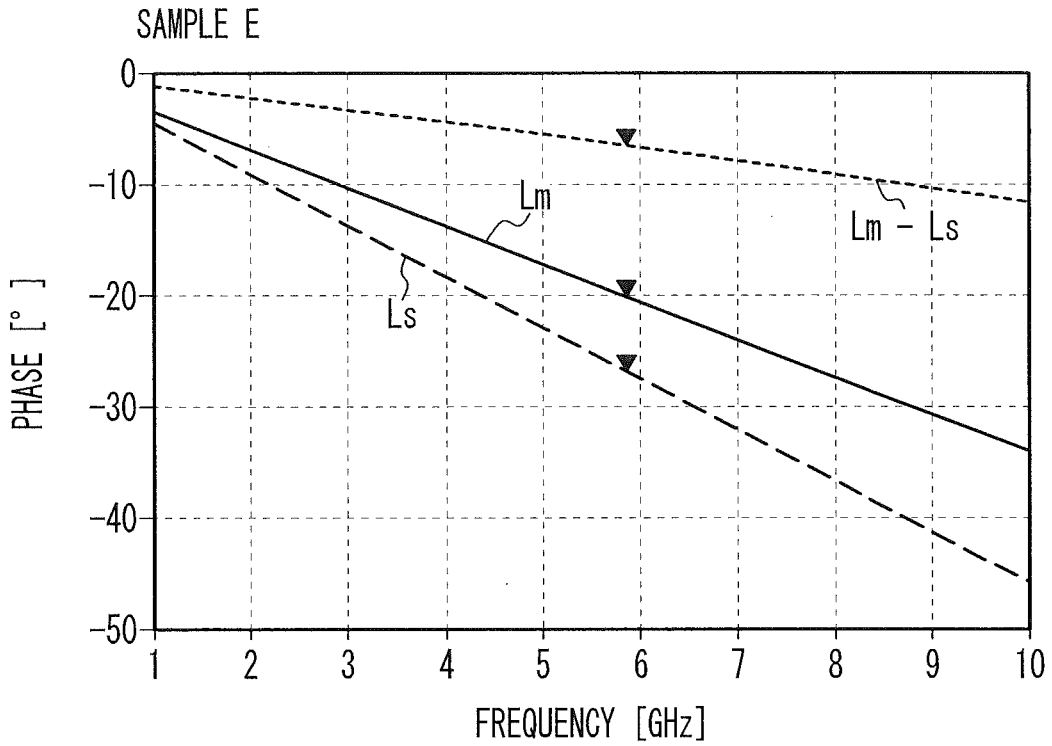
FIG. 17A is a graph of phase versus frequency in the sample E.
Figure 17B:
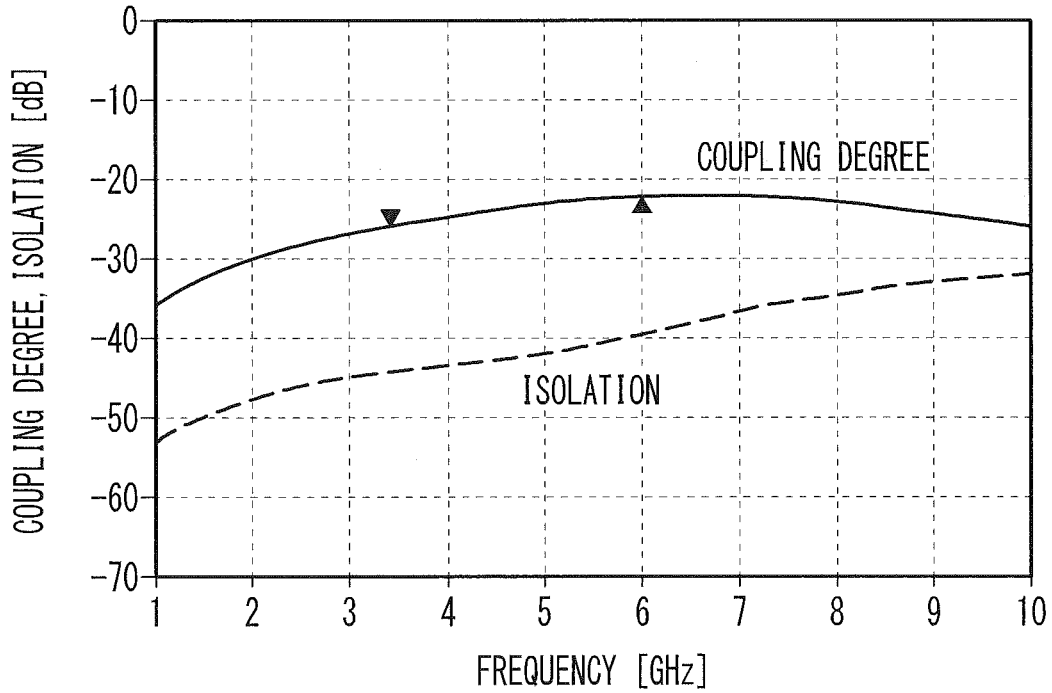
FIG. 17B is a graph of a coupling degree and isolation versus frequency in the sample E.

FIG. 17A is a graph of phase versus frequency in the sample E, and FIG. 17B is a graph of the coupling degree and the isolation versus frequency in the sample E. As illustrated in FIG. 17A, the phase difference of the sample E is less than that of the sample B. As presented in Table 2, the phase difference of the sample E is 6.70°.

As illustrated in FIG. 17B, the isolation of the sample E is less than the isolation of the sample B in FIG. 14B. As presented in Table 2, the difference in coupling degree of the sample E is 3.64 dB, which is greater than that of the sample B. The minimum isolation of the sample E is −40 dB, which is less than that of the sample B.

When the thickness T5 is made to be greater than the thickness T4 as in the sample E, the phase difference decreases. The difference in coupling degree increases, and the isolation decreases. As described above, the difference in coupling degree and the isolation deteriorate.

The simulation 1 reveals that the phase difference becomes larger when the thickness T1 is made to be less than the thickness T2, and the difference in coupling degree and the isolation improve. The simulation 1 also reveals that the phase difference becomes larger when the thickness T4 is made to be greater than the thickness T5, and the difference in coupling degree and the isolation improve.

Simulation 2

Figure 18:
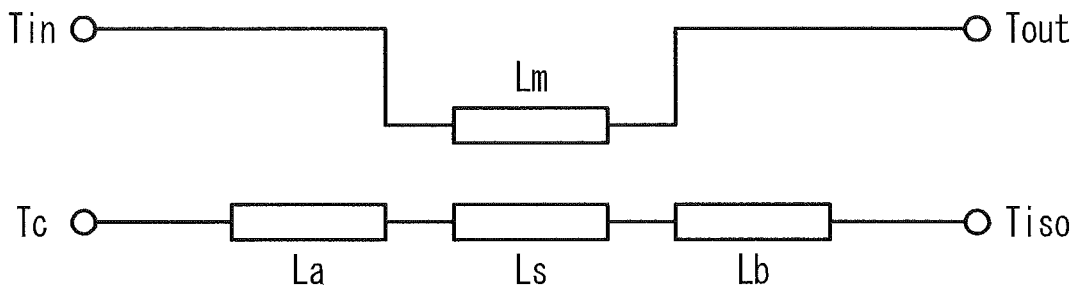
FIG. 18 is a circuit diagram of a directional coupler in a simulation 2.

A simulation 2 was conducted to study the influence of the phase difference on the difference in coupling degree. FIG. 18 is a circuit diagram of a directional coupler in the simulation 2. As illustrated in FIG. 18, the main lines Lm and Ls are provided. A line La is connected between the sub line Ls and the coupling terminal Tc. A line Lb is connected between the sub line Ls and the isolation terminal Tiso.

The phase difference between the main line Lm and the sub line Ls was varied by varying the electrical lengths of the lines La and Lb. Each line is a microstripline having a structure in which ground electrodes face each other across a dielectric layer.

Width of the line L1: 25 μm

Width of the line L4: 25 μm

Distance between the lines L1 and L4: 50 μm

Length along which the lines L1 and L4 face each other: 785 μm

Relative permittivity of the dielectric layer: 10

Distance between the line and the ground electrode: 200 μm

Figure 19:
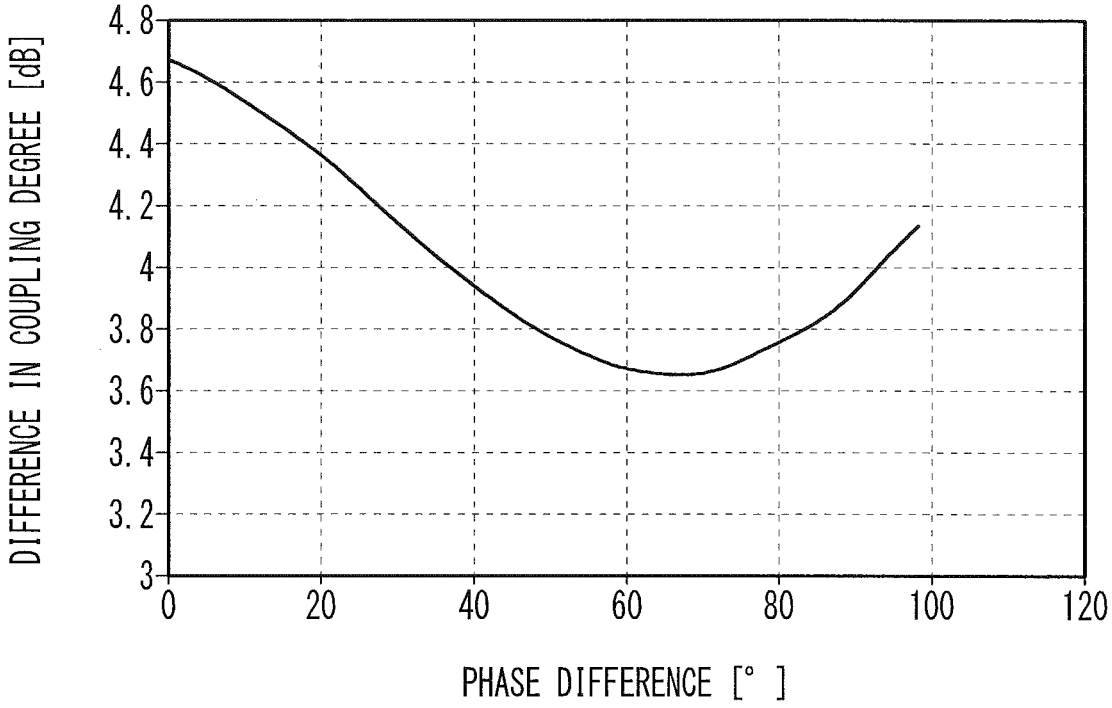
FIG. 19 is a graph of difference in coupling degree versus phase difference in the simulation 2.

FIG. 19 is a graph of difference in coupling degree versus phase difference in the simulation 2. The phase difference is the phase difference between the main line Lm and the sub line Ls. The difference in coupling degree is the difference between the coupling degree at 3.4 GHz and the coupling degree at 6 GHz. As illustrated in FIG. 19, as the phase difference increases, the difference in coupling degree decreases. When the phase difference is approximately 70°, the difference in coupling degree is at a minimum. This is considered because the electromagnetic field coupling between the main line Lm and the sub line Ls weakens as the phase difference increases.

According to the simulation 2, even in a simple directional coupler, as the phase difference increases, the difference in coupling degree decreases. Accordingly, the reason why the difference in coupling degree of each of the samples B through E is less than that of the sample A in the simulation 1 is considered the increase in phase difference.

Simulation 3

In the simulation 1, the isolation is approximately the same between the sample D, of which the thickness T4 is greater than the thickness T5, and the sample B. Thus, for the samples B, D, and E, an electromagnetic field simulation was conducted based on a three dimensional structure.

Figure 20:
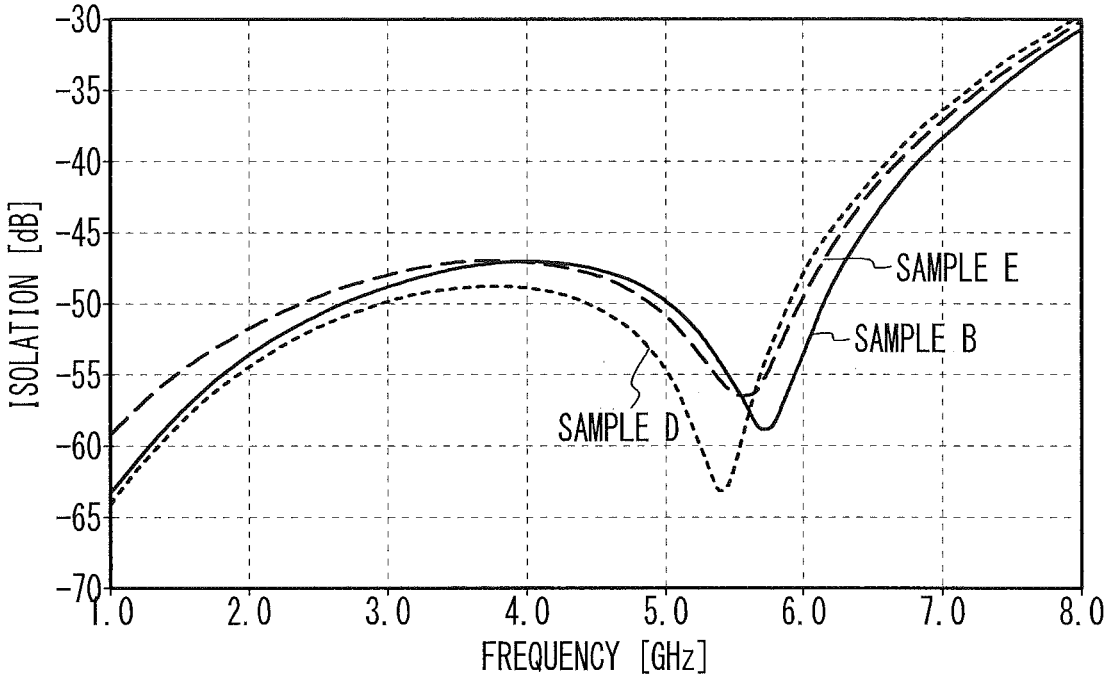
FIG. 20 is a graph of isolation versus frequency in a simulation 3.

FIG. 20 is a graph of the isolation versus frequency in a simulation 3. As illustrated in FIG. 20, the isolation of the sample D is greater than that of the sample B, and the isolation of the sample E is less than that of the sample B.

Table 3 presents the difference in coupling degree and the minimum isolation in the simulation 3.

TABLE 3

| Sample | T4 (μm) | T5 (μm) | Difference in coupling degree [dB] | Minimum isolation [dB] |
|---|---|---|---|---|
| B | 8 | 8 | 1.38 | −47.06 |
| D | 15 | 8 | 1.36 | −48.71 |
| E | 8 | 15 | 1.51 | −46.97 |

As presented in Table 3, the sample D, of which the thickness T4 is greater than the thickness T5, has a less difference in coupling degree than the sample B and greater isolation than the sample B. The sample E, of which the thickness T4 is less than the thickness T5, has a greater difference in coupling degree than the sample B and less isolation than the sample B.

As in the simulation 1, when the thickness T1 is made to be less than the thickness T2, the difference in coupling degree decreases, and the isolation increases. As in the simulations 1 and 3, when the thickness T4 is made to be greater than the thickness T5, the difference in coupling degree decreases, and the isolation increases.

The reason is not clear, but the characteristic impedance of the transmission line is considered to be related. The characteristic impedance decreases as the capacitance component increases, and decreases as the inductance component decreases. When the thickness T1 is made to be less, the capacitance component increases, and the characteristic impedance thus decreases. When the thickness T4 is made to be larger, the inductance component decreases, and the characteristic impedance thus decreases.

As in the simulation 1, as the characteristic impedances of the lines L1 and L4 in the middle decrease, the coupling degree between the lines L1 and L4 becomes less than the sum of the coupling degrees between the lines L2*a* and L5*a* and between the lines L2*b* and L5*b*, and the sum of the coupling degrees between the lines L3*a* and L6*a* and between the lines L3*b* and L6*b*. This is considered the reason why the phase difference between the main line Lm and the sub line Ls becomes larger. As in the simulation 2, it is considered that the difference in coupling degree decreases as the phase difference increases. Accordingly, it is considered that the difference in coupling degree is small and the isolation is large in the second embodiment as in the simulations 1 and 3.

In the samples B through E in the second embodiment, the main line Lm includes the line L1 (a first line), the lines L2*a* and L2*b* (a second line) connecting the line L1 and the input terminal Tin, and the lines L3*a* and L3*b* (a third line) connecting the line L1 and the output terminal Tout. The sub line Ls includes the line L4 (a fourth line), the lines L5*a* and L5*b* (a fifth line) connecting the line L4 and the coupling terminal Tc, and the lines L6*a* and L6*b* (a sixth line) connecting the line L4 and the isolation terminal Tiso. The lines L1 and L4 are electromagnetically coupled with each other, the lines L2*a* and L2*b* are electromagnetically coupled with the lines L5*a* and L5*b*, and the lines L3*a* and L3*b* are electromagnetically coupled with the lines L6*a* and L6*b*.

In such a structure, each of the shortest distances (the thickness T1 in the first embodiment) between the lines L1 and L4 and the ground electrode G1 (a ground conductor) is made to be less than each of the shortest distances (the thickness T2) between the lines L2*a*, L2*b*, L3*a*, L3*b*, L5*a*, L5*b*, L6*a*, and L6*b* and the ground electrode G1. This configuration makes the characteristic impedances of the lines L1 and L4 smaller, the flatness of the coupling degree smaller, and the isolation larger.

The thickness T1 is preferably equal to or less than a half of the thickness T3, more preferably equal to or less than one-fifth of the thickness T3, further preferably equal to or less than one-tenth of the thickness T3.

As in the sample D, at least a part of the line L1 and at least a part of the line L4 are thicker than the lines L2*a*, L2*b*, L3*a*, L3*b*, L5*a*, L5*b*, L6*a*, and L6*b*. This configuration makes the flatness of the coupling degree smaller, and the isolation larger.

The thickness T4 is preferably equal to or greater than 1.2 times the thickness T5, more preferably equal to or greater than 1.5 times the thickness T5.

To reduce the characteristic impedance of the lines L1 and L4, the width of each of the lines L1 and L4 may be made to be greater than the width of each of the lines L2*a*, L2*b*, L3*a*, L3*b*, L5*a*, L5*b*, L6*a*, and L6*b*.

The main line Lm and the sub line Ls are formed of the conductor pattern 12 formed on the surface of at least one of the dielectric layers 11*a* through 11*i*. The formation of the main line Lm and the sub line Ls on the layered body 10 in this manner reduces the size of the directional coupler.

As illustrated in FIG. 4 and FIG. 6A, the lines L1 and L4 are formed of the conductor pattern 12 (a second conductor pattern) formed on the surface of the dielectric layer 11*b*. The lines L2*b*, L3*b*, L5*b*, and L6*b* are formed of the conductor pattern 12 formed on the surface of the dielectric layer 11*e* (a dielectric layer different from the dielectric layer 11*b*). The formation of the lines L1 and L4 on a dielectric layer different from the dielectric layer having other lines formed thereon reduces the size of the directional coupler.

As illustrated in FIG. 4, FIG. 6C, and FIG. 7C, the ground electrode G1 is formed of the conductor pattern 12 (a third conductor pattern) formed on the surface of the dielectric layer 11*c* (a third dielectric layer) located between the dielectric layers 11*b* and 11*e*. As described above, when the thickness of the dielectric layer is set by providing the ground electrode G1 between the lines L1 and L4 and the lines L2*b*, L3*b*, L5*b*, and L6*b*, the shortest distances between the ground electrode G1 and the lines L1 and L4 can be made to be less than the shortest distances between the ground electrode G1 and the lines L2*b*, L3*b*, L5*b*, and L6*b*.

As illustrated in FIG. 4, FIG. 6A, FIG. 6C, and FIG. 7C, the lines L1 and L4 overlap with the ground electrode G1 in plan view. On the other hand, none of the lines L2*a*, L2*b*, L3*a*, L3*b*, L5*a*, L5*b*, L6*a*, and L6*b* overlaps with the ground electrode G1 in plan view. This structure makes the characteristic impedances of the lines L2*a*, L2*b*, L3*a*, L3*b*, L5*a*, L5*b*, L6*a*, and L6*b* high. Accordingly, the flatness of the coupling degree and the isolation further improve.

As illustrated in FIG. 2, the lines L2*a* and L2*b* are connected in parallel between the input terminal Tin and the line L1. The lines L3*a* and L3*b* are connected in parallel between the line L1 and the output terminal Tout. This structure reduces the insertion loss of the main line Lm.

The lines L5*a* and L5*b* are connected in series between the coupling terminal Tc and the line L4, and are respectively electromagnetically coupled with the lines L2*a* and L2*b*. The lines L6*a* and L6*b* are connected in series between the line L4 and the isolation terminal Tiso, and are respectively electromagnetically coupled with the lines L3*a* and L3*b*. This structure makes the coupling degree large.

Each of the lines L2*a* and L2*b*, the lines L3*a* and L3*b*, the lines L5*a* and L5*b*, and the lines L6*a* and L6*b* includes a line winding in plan view. This configuration makes the characteristic impedances of the lines L2*a*, L2*b*, L3*a*, L3*b*, L5*a*, L5*b*, L6*a*, and L6*b* high. Accordingly, the flatness of the coupling degree and the isolation further improve.

The line L1 (a first main line pattern) and the line L4 (a first sub line pattern) are located on the surface of the dielectric layer 11*b*. At least a part of the line L4 is located along at least a part of the line L1. The ground electrode G1 (a ground pattern) is located on the surface of the dielectric layer 11*c*, and overlaps with at least a part of the line L1 and at least a part of the line L4. The lines L2*b*, L3*b*, L5*b*, and L6*b* are located on the surface of the dielectric layer 11*e*. The line L2*b* is coupled with a first end of the line L1. The line L3*b* is coupled with a second end of the line L1. The line L5*b* is coupled with a first end of the line L4. The line L6*b* is coupled with a second end of the line L4. At least a part of the line L5*b* is located along at least a part of the line L2*b*, and at least a part of the line L6*b* is located along at least a part of the line L3*b*. This structure reduces the size of the directional coupler.

The second embodiment has described an example in which the second line, the third line, the fifth line, and the sixth line are located on dielectric layers, but the second line, the third line, the fifth line, and the sixth line may be formed on a single dielectric layer. An example in which the first line and the fourth line are located on a single dielectric layer has been described, but the first line and the fourth line may be formed on dielectric layers.

An example in which the ground electrodes G1 are located between the first and fourth lines and the second, third, fifth, and sixth lines has been described, but the first line and the sixth line may be located between the ground electrode G2 and the second line, the third line, the fifth line, and the sixth line.

An example in which at least a part of the line L1 and at least a part of the line L4 overlap with the ground electrode G1 in plan view has been described, but the lines L1 and L4 may not necessarily overlap with the ground electrode G1. An example in which none of the lines L2*a*, L2*b*, L3*a*, L3*b*, L5*a*, L5*b*, L6*a*, and L6*b* overlaps with the ground electrode G1 in plan view, but at least one of the lines L2*a*, L2*b*, L3*a*, L3*b*, L5*a*, L5*b*, L6*a*, and L6*b* may overlap with the ground electrode G1.

An example in which the lines L2*a* and L2*b* are connected in parallel and the lines L3*a* and L3*b* are connected in parallel has been described, but the lines L2*a* and L2*b* may be connected in series, and the lines L3*a* and L3*b* may be connected in series. An example in which the lines L5*a* and L5*b* are connected in series and the lines L6*a* and L6*b* are connected in series has been described, but the lines L5*a* and L5*b* may be connected in parallel, and the lines L6*a* and L6*b* may be connected in parallel.

An example in which the thickness T1 is 15 μm, the thickness T2 is 200 μm, the thicknesses T3 through T5 are 8 μm or 15 μm has been described, but the thicknesses T1, T2, T3, through T5 can be appropriately set. For example, the thickness T1 may be appropriately set from 8 μm to 100 μm.

Although the embodiments of the present invention have been described in detail, it is to be understood that the various change, substitutions, and alterations could be made hereto without departing from the spirit and scope of the invention.

What is claimed is:

1. A directional coupler comprising:

an input terminal;

an output terminal;

a coupling terminal;

an isolation terminal;

a main line electrically connected between the input terminal and the output terminal, the main line including a first line, a second line connecting the first line and the input terminal, and a third line connecting the first line and the output terminal;

a sub line electrically connected between the coupling terminal and the isolation terminal, the sub line including a fourth line electromagnetically coupled with the first line, a fifth line electromagnetically coupled with the second line, and a sixth line electromagnetically coupled with the third line, the fifth line connecting the fourth line and the coupling terminal, and the sixth line connecting the fourth line and the isolation terminal, and a ground conductor, a shortest distance between the ground conductor and the first line and a shortest distance between the ground conductor and the fourth line being less than a shortest distance between the second line and the ground conductor, a shortest distance between the third line and the ground conductor, a shortest distance between the fifth line and the ground conductor, and a shortest distance between the sixth line and the ground conductor, wherein no other ground conductor is located between the ground conductor and the first line, between the ground conductor and the second line, between the ground conductor and the third line, between the ground conductor and the fourth line, between the ground conductor and the fifth line and the ground conductor and the sixth line.

2. The directional coupler according to claim 1, wherein at least a part of at least one of the first line and the fourth line is thicker than the second line, the third line, the fifth line, and the sixth lines.

3. The directional coupler according to claim 1, further comprising a plurality of dielectric layers, wherein the main line and the sub line are formed of a conductor pattern formed on a surface of at least one of the plurality of dielectric layers.

4. The directional coupler according to claim 1, wherein the second line is provided in plural, the second lines being connected in parallel between the input terminal and the first line, the fifth line is provided in plural, the fifth lines are connected in series between the coupling terminal and the fourth line, each of the fifth lines being electromagnetically coupled with a corresponding one of the second lines, the third line is provided in plural, the third lines being connected between the first line and the output terminal, and the sixth line is provided in plural, the six lines being connected in series between the fourth line and the isolation terminal, each of the sixth lines being electromagnetically coupled with a corresponding one of the third lines.

5. The directional coupler according to claim 1, wherein each of the second line, the third line, the fifth line, and the sixth line includes a winding line.

6. A directional coupler comprising:

an input terminal;

an output terminal;

a coin lint terminal;

an isolation terminal;

a main line electrically connected between the input terminal and the output terminal, the main line including a first line, a second line connecting the first line and the input terminal, and a third line connecting the first line and the output terminal;

a sub line electrically connected between the coupling terminal and the isolation terminal, the sub line including a fourth line electromagnetically coupled with the first line, a fifth line electromagnetically coupled with the second line, and a sixth line electromagnetically coupled with the third line, the fifth line connecting the fourth line and the coupling terminal, and the sixth line connecting the fourth line and the isolation terminal, a ground conductor, a shortest distance between the ground conductor and the first line and a shortest distance between the ground conductor and the fourth line being less than a shortest distance between the second line and the ground conductor, a shortest distance between the third line and the ground conductor, a shortest distance between the fifth line and the ground conductor, and a shortest distance between the sixth line and the ground conductor; and a plurality of dielectric layers that are stacked, wherein the first line and the fourth line are formed of a first conductor pattern formed on a surface of a first dielectric layer of the plurality of dielectric layers, and the second line, the third line, the fifth line, and the sixth line are formed of a second conductor pattern formed on a surface of a second dielectric layer different from the first dielectric layer of the plurality of dielectric layers.

7. The directional coupler according to claim 6, wherein the ground conductor is formed of a third conductor pattern formed on a surface of a third dielectric layer located between the first dielectric layer and the second dielectric layer of the plurality of dielectric layers.

8. The directional coupler according to claim 7, wherein the first line and the fourth line overlap with the ground conductor in plan view, and none of the second line, the third line, the fifth line, and the sixth line overlaps with the third conductor pattern in plan view.

9. A directional coupler comprising;

a first dielectric layer;

a first main line pattern located on a surface of the first dielectric layer;

a first sub line pattern located on the surface of the first dielectric layer, at least a part of the first sub line pattern being located along at least a part of the first main line pattern;

a second dielectric layer overlapping with the first dielectric layer;

a ground pattern located on a surface of the second dielectric layer and overlapping with the first main line pattern and the first sub line pattern;

a third dielectric layer located so as to sandwich the second dielectric layer between the third dielectric layer and the first dielectric layer;

a second main line pattern located on a surface of the third dielectric layer and coupled with a first end of the first main line pattern;

a second sub line pattern located on the surface of the third dielectric layer and coupled with a first end of the first sub line pattern, at least a part of the second sub line pattern being located along at least a part of the second main line pattern;

a third main line pattern located on the surface of the third dielectric layer and coupled with a second end of the first main line pattern; and a third sub line pattern located on the surface of the third dielectric layer and coupled with a second end of the first sub line pattern, at least a part of the third sub line pattern being located along at least a part of the third main line pattern.

10. The directional coupler according to claim 9, wherein a shortest distance between the first main line pattern and the ground pattern and a shortest distance between the first sub line pattern and the ground pattern are less than a shortest distance between the second main line pattern and the ground pattern, a shortest distance between the second sub line pattern and the ground pattern, a shortest distance between the third main line pattern and the ground pattern, and a shortest distance between the third sub line pattern and the ground pattern.

* * * * *